US012729679B1

(12) United States Patent
Michalcik et al.

(10) Patent No.: US 12,729,679 B1
(45) Date of Patent: Sep. 8, 2026

(54) HEADER RING

(71) Applicant: UTEX INDUSTRIES, INC., Houston, TX (US)

(72) Inventors: Shane Michael Michalcik, Hallettsville, TX (US); Ricardo Jose Betancourt, Katy, TX (US)

(73) Assignee: UTEX INDUSTRIES, INC., Houston, TX (US)

( * ) Notice: Subject to any disclaimer, the term of this patent is extended or adjusted under 35 U.S.C. 154(b) by 0 days.

(21) Appl. No.: 19/416,882

(22) Filed: Dec. 11, 2025

Related U.S. Application Data

(60) Provisional application No. 63/766,571, filed on Mar. 4, 2025.

(51) Int. Cl.
*F04B 53/16* (2006.01)
*F04B 53/02* (2006.01)

(52) U.S. Cl.
CPC ..... *F04B 53/164* (2013.01); *F04B 53/02* (2013.01)

(58) Field of Classification Search
CPC ..... F04B 53/02; F04B 53/164; F16J 15/108; F16J 15/328; B29C 45/26; B29D 99/0053; B29L 2031/26
See application file for complete search history.

(56) References Cited

U.S. PATENT DOCUMENTS 3,271,039 A * 9/1966 Kohl ..... F16J 15/20 264/257
4,440,404 A * 4/1984 Roach ..... F16J 15/166 277/584
5,493,951 A * 2/1996 Harrison ..... F16J 15/182 92/155
9,845,801 B1 * 12/2017 Shek ..... F04B 53/02
D893,684 S * 8/2020 Matthys ..... D23/269
11,143,305 B1 * 10/2021 Matthys ..... F16J 15/166
11,391,374 B1 * 7/2022 Ellisor ..... F04B 53/164
11,668,399 B2 * 6/2023 Dietle ..... B29C 43/18 249/63
12,018,676 B2 * 6/2024 Chase ..... F04B 53/164
2009/0166980 A1 * 7/2009 Miller ..... F16J 15/166 277/540
2016/0319626 A1 * 11/2016 Dille ..... F16L 15/04
2019/0170137 A1 * 6/2019 Chase ..... F04B 53/164
2022/0034402 A1 * 2/2022 Kiani ..... F16J 15/187

* cited by examiner

*Primary Examiner* — Thomas E Lazo

(74) *Attorney, Agent, or Firm* — Haynes and Boone, LLP; Mark A. Tidwell

(57) ABSTRACT

A header ring for use as a sealing element in a stuffing box disposed about a plunger of a reciprocating pump. The header ring is formed of an annular body disposed about a primary axis. The annular body includes an inner annular surface closest to the primary axis and an outer annular surface spaced radially outward from the inner annular surface. A first connecting surface extends between the inner annular surface and the outer annular surface, while a second connecting surface spaced apart from the first connecting surface, extends between the inner annular surface and the outer annular surface. The inner annular surface has a first transition portion and a second transition portion with an elongated inner flat portion extending therebetween. The elongated inner flat portion extends axially closest to the primary axis and is parallel with the primary axis.

21 Claims, 9 Drawing Sheets

FIG. 7

HEADER RING

CROSS-REFERENCE TO RELATED APPLICATIONS

This application claims priority to U.S. Provisional Pat. App. No. 63/766,571, filed Mar. 4, 2025, the disclosure of which is incorporated by reference herein in its entirety.

TECHNICAL FIELD

The present invention relates to a packing or seal assembly for a pump and more particularly to a header ring for use in such an assembly.

BACKGROUND

Piston pumps or plunger pumps are positive displacement pumps that are commonly used in environments where the fluids that are being pumped may render pumping more difficult, such as high temperature fluid, viscous and very viscous fluids or fluids charged with solids.

One important use of plunger pumps is in the oil and gas industry and particularly in the drilling, completion and/or stimulation of oil or gas wells. In these applications, it is common to employ solids laden drilling fluids, e.g., muds, cement slurries, fracturing slurries, acids and the like, which frequently must be pumped under high pressure into the well. This is particularly true in the case of completion and/or stimulation procedures, where fluids are pumped at very high pressures and typically consist of slurries which make the fluids highly abrasive because of the large solids content of the slurries.

As is well known in the art, positive displacement reciprocating plunger-type pumps in this environment pose difficult sealing problems at the high pressure end where the abrasive fluid must be prevented from leaking between the reciprocating plunger and the cylinder or housing within which the plunger reciprocates.

Although a variety of sealing or packing systems are known to seal between the reciprocating plunger and the cylinder, a typical seal arrangement comprises one or more V-shaped or Chevron packing rings with various male and female adaptor rings at the forward and rearward ends of the packing assembly. To ensure sealing between the plunger and the cylinder, the sealing assembly can be placed under compression by an adjusting ring, spring loading, etc.

A typical packing assembly of the type under discussion includes a header ring which is typically made of an elastomeric material. The header ring can be constructed of a homogeneous elastomeric material or an elastomeric material containing layers of cloth or other reinforcing type materials. It is also known to cover certain surfaces of the header ring with a reinforcing fabric.

It has been found that, with respect to the header ring, failure of the sealing assembly primarily occurs due to a phenomenon known as "nibbling" where solids within the pumped fluid cause degradation of the header ring at the interface with the plunger, resulting in gouges or other loss of material at or adjacent the interface.

This nibbling phenomenon can be best understood by reference to FIGS. 1-2 which depict the prior art construction for header rings of the type under consideration. FIG. 1 depicts a typical elastomeric header ring shown as 10. As can be seen in FIG. 1, header ring 10 is made of an elastomeric material and comprises an annular body portion 12.

Integrally formed as part of body 12 is an annular, radially inwardly projecting wiping lip 14, an annularly extending, axially facing bead 16, and an annular pedestal portion 18. Wiping lip 14 includes a radially inwardly facing convex sealing surface 26 when uncompressed which convex sealing surface 26 has an apex 27 at the innermost radius of body 12. An annularly extending, radially outwardly facing cylindrical surface 22 interconnects pedestal portion 18 with bead 16. Pedestal portion 18 includes an annularly extending planar surface 20 interconnecting outwardly facing cylindrical surface 22 with radially inwardly facing convex sealing surface 26. At the junction of radially inwardly facing convex sealing surface 26 and annularly extending planar surface 20, an annularly extending juncture 28 may be formed, which may include an annularly extending, radially inwardly facing cylindrical surface 24.

FIG. 2 depicts a typical stuffing box, shown generally as 30, in which is disposed a typical sealing assembly 32 for use in a plunger-type pump. Stuffing box 30 may include a housing 34 having a bore 36 extending therethrough, bore 36 defining a cylindrical surface 38. Housing 34 has a shoulder portion 42. Movably, e.g., reciprocally, positioned in bore 36 is a plunger, piston or shaft 44. Sealing assembly 32 generally includes an annular gland 46, an annular header ring 10, an annular first seal ring 50, and an annular second seal ring 52. The sealing assembly 32 also includes a top, annular adaptor ring 56 and an annular bushing 58. As can be seen, header ring 10 forms a wiper ring at the high pressure end of the sealing assembly 32, its primary function being to prevent abrasives/solids from entering the region where the seal rings 50 and 52 are positioned and thereby prevent excessive wear on seal rings 50 and 52. It is also to be noted that, as shown in FIG. 2, header ring 10 no longer has the shape shown in, for example, FIG. 1 since the radially inwardly extending wiping lip 14 has been compressed to effect sealing between the plunger 44 and the housing 34, the cylindrical surface 38 being in sealing engagement with an annular, radially outwardly facing surface 60 of the compressed header ring 10, which is generally cylindrical.

One drawback to the above-described header rings is that during the formation process, flashing may form at the apex 27 of the inwardly facing convex sealing surface 26. Specifically, such header rings are typically formed in a two-part mold assembly, where a first mold shell and a second mold shell engage one another at the apex 27 of the inwardly facing convex sealing surface, it being understood that in order to extract the molded header ring 10 from the mold assembly after formation, the mold shells must engage one another at the inner most and outer most radial surface of the header ring. Moreover, it is well known that flashing commonly forms at the point of engagement of opposing mold shells. With respect to header ring 10, such flashing is undesirable because the inwardly facing convex sealing surface, and in particular apex 27 where the flashing forms, is the highest contact area of the header ring during sealing. Any flashing present in the areas can impact the performance of the header ring. Moreover, post mold processing to remove flashing can likewise reduce surface smoothness at this point of sealing, reducing the sealing effectiveness of the header ring.

BRIEF DESCRIPTION OF THE DRAWINGS

For a more complete understanding of the present disclosure and its features and advantages, reference is now made to the following description, taken in conjunction with the accompanying drawings, in which.

DESCRIPTION OF THE PREFERRED EMBODIMENTS

Described herein is a header ring for use as a sealing element in a stuffing box disposed about a plunger of a reciprocating pump. The header ring is formed of an annular body disposed about a primary axis. The annular body includes having an inner annular surface closest to the primary axis and an outer annular surface spaced radially outward from the inner annular surface. An upper or first connecting surface extends between the inner annular surface and the outer annular surface, while a lower or second connecting surface extends between the inner annular surface and the outer annular surface. The inner annular surface has a first transition portion and a second transition portion with an elongated inner flat portion extending linearly between the first transition portion and the second transition portion. Moreover, the inner flat portion extends axially so as to be parallel with the primary axis and may be centrally located along the inner annular surface between the first connecting surface and the second connecting surface.

Figure 2:
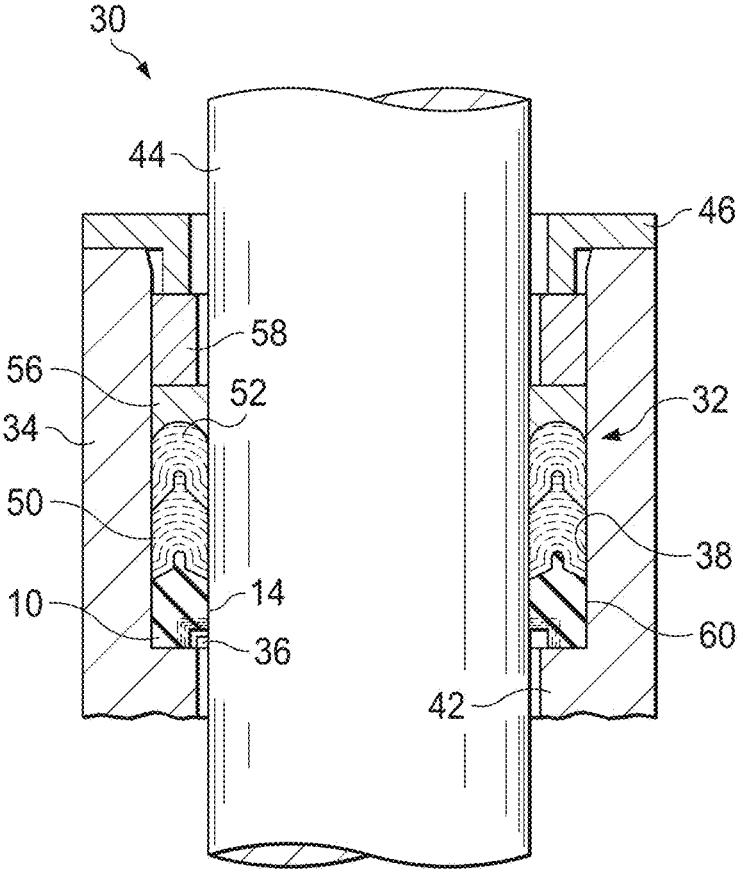
FIG. 2 (PRIOR ART)
FIG. 2 is a schematic view, partly in section, of a sealing assembly and stuffing box of the prior art.
Figure 3:
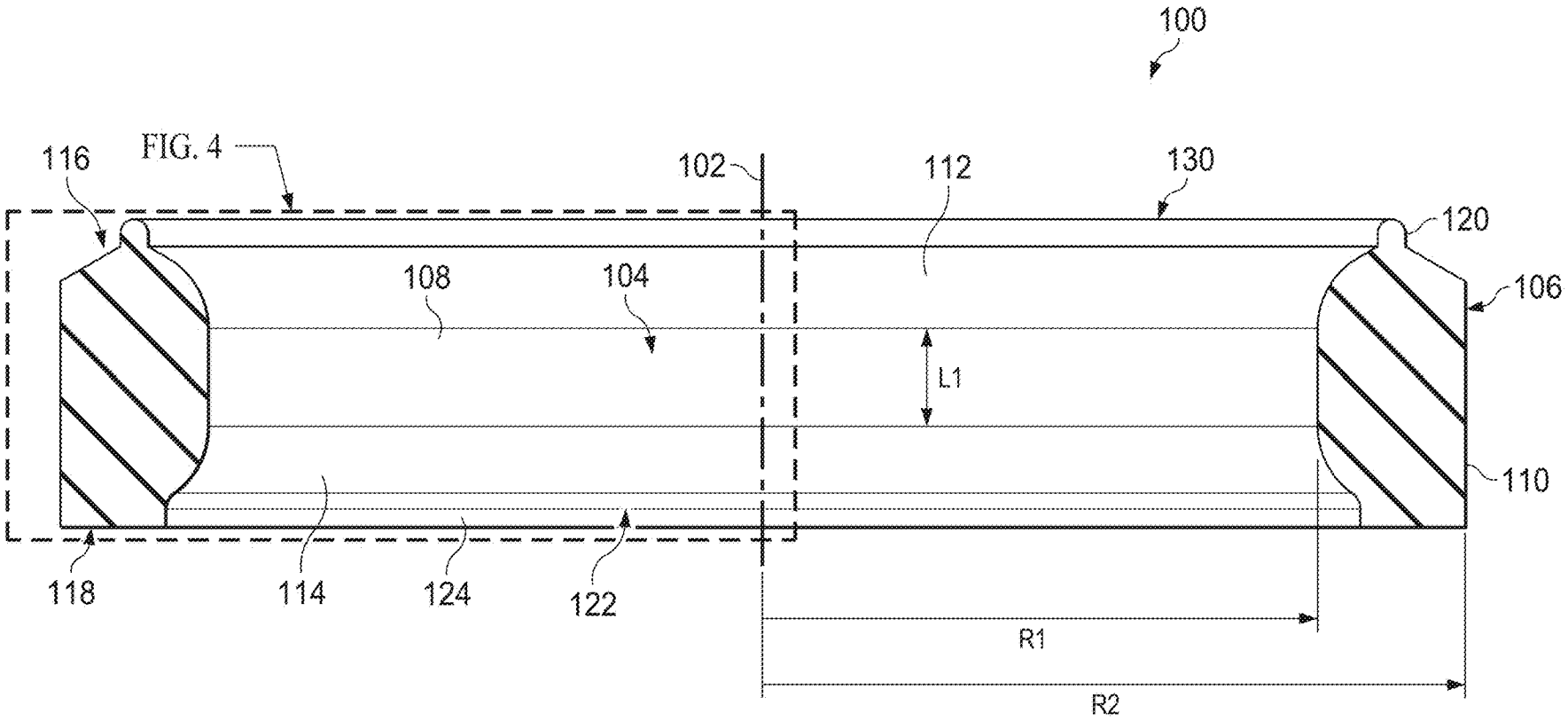
FIG. 3 is a cross-sectional view of one embodiment of a header ring with an elongated piston contact surface.
Figure 4:
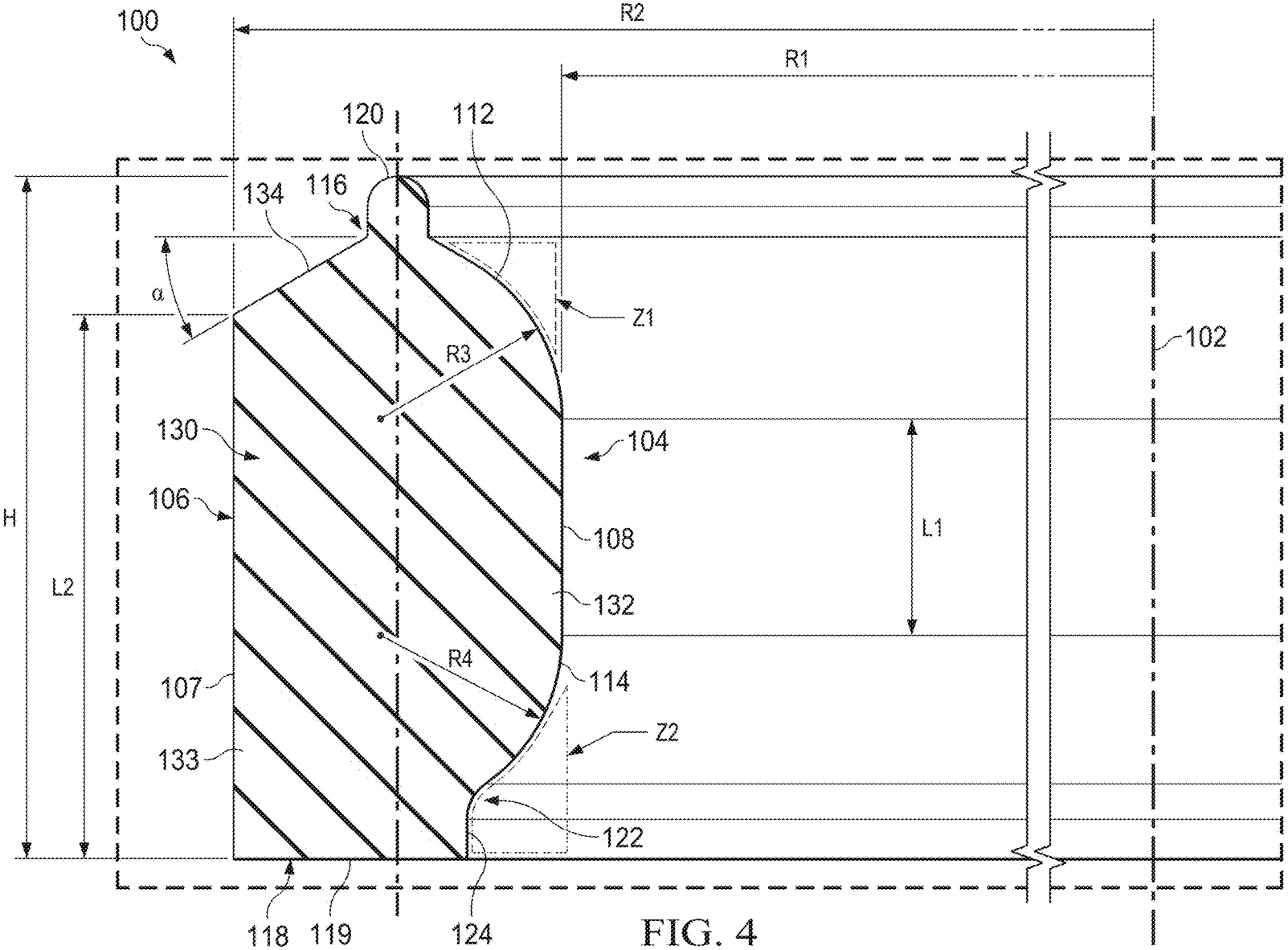
FIG. 4 is another cross-sectional view of the header ring of FIG. 3.

With reference to FIGS. 3 and 4, a header ring 100 is illustrated in cross-section where header ring 100 is formed of an annular body 130 disposed about primary axis 102. Annular body 130 includes an inner annular surface 104 for sealing against a plunger (not shown) and an outer annular surface 106 for engaging a stuffing box wall (not shown) or other structure. Inner annular surface 104 is shaped to have a centrally located, elongated primary sealing surface 108 that is flat at the innermost radius R1 of header ring 100 and has an uncompressed axial length L1. As used herein, uncompressed means that primary sealing surface 108 has length L1 prior to deployment or engagement with a piston shaft. For the purposes of this disclosure, any reference to length L1 refers to the length of elongated primary sealing surface 108 in an uncompressed state. Outer annular surface 106 may likewise include an elongated surface 110 that may be flat at the outermost radius R2 of header ring 100. In other embodiments, outer annular surface 106 need not be flat, but may be shaped to cooperate with the housing 34 (see FIG. 2) or other structure in which header ring 100 is deployed.

By elongating primary sealing surface 108, the contact pressure of primary sealing surface 108 with a plunger (not shown) is spread out over a larger area, thus reducing localized wear and extending the potential operational life of header ring 100. This is in contrast to prior art header rings with a convex sealing surface where peak contact pressure is concentrated at the apex of the convex sealing surface.

In addition, an elongated primary sealing surface 108 as described allows for the optimization of R1 to R2 when header ring 100 is in an uncompressed state. Specifically, R1 is larger than the inner radius of prior art header rings because the need for the significant compression required of a prior art header ring is reduced by header ring 100 while still maintaining the desired sealing. Thus, in one or more embodiments, the ratio of R1 to R2 is larger than the ratio R1 to R2 of prior art header rings. Put another way, the calculated squeeze placed on a piston (not shown) by header ring 100 is less than the calculated squeeze placed on a piston by a prior art header ring with a smaller inner radius R1.

Inner annular surface 104 may further include a first transition portion 112 and a second transition portion 114, where first transition portion 112 segues into a first connecting surface 116 and second transition portion 114 segues into second connecting surface 118. In each case, the first transition portion 112 and the second transition portion 114 extend away from the centrally located, elongated primary sealing surface 108 and primary axis 102. In this regard, one or both of first transition portion 112 and the second transition portion 114 may be radiused to have a convex shape. Regardless of the shape of first transition portion 112 and second transition portion 114, primary sealing surface 108 is located therebetween and therefore centrally located along inner annular surface 104. In this regard, for the reasons set forth herein, centrally located, elongated primary sealing surface 108 is spaced apart from at least second connecting surface 118. In yet other embodiments, primary sealing surface 108 is spaced apart from each of first connecting surface 116 and second connecting surface 118 by the respective first transition portion 112 and the second transition portion 114.

While first transition portion 112 and second transition portion 114 are shown as radiused to have a convex shape in FIG. 3, in other embodiments, one or both of first transition portion 112 and second transition portion 114 may be angular in shape so as to form an edge (not shown) at the intersection with primary sealing surface 108.

Optionally, first connecting surface 116 may include a projection 120 extending away from first connecting surface 116, where projection 120 is disposed to engage an adjacent seal component (not shown) as is known in the art.

Optionally, inner annular surface 104 may also include a concave shoulder 122 having an axially extending surface 124 forming a pedestal at second connecting surface 118.

Optionally, header ring 100 may be fully or partially wrapped or embedded with an abrasion resistant material, such as a flexible fabric, a semi-rigid thermoplastic lattice with abrasion-resistant and heat-resistant properties, such as polyether ether ketone (PEEK), polyphenylene sulfide (PPS) or flexible thermoplastic lattice with abrasion-resistant and heat-resistant properties, such as thermoplastic polyurethane (TPU) or high-performance polyimides (PI). In yet other embodiments, the abrasion resistant material may only be embedded in or otherwise disposed along the flat, elongated primary sealing surface 108.

FIG. 4 illustrates the header ring 100 of FIG. 3 in more detail. Referring first to FIG. 4, annular body 130 is formed of a resilient core 132. Resilient core 132 may be fabricated of at least a first material 133. In one or more embodiments, resilient core 132 may be formed of homogenous rubber. As will be described below, it will be appreciated that because inner annular surface 104 of header ring 100 need not compress to the same degree as prior art header rings in order to achieve desired sealing, resilient core 132 may be formed of a harder, more durable material than prior art header rings. Thus, in one or more embodiments, first material 133 may have an equivalent shore hardness scale of 90 A or greater, where equivalent shore hardness means an unwrapped resilient core 132 of 90 A or a fabric wrapped resilient core of at least 80 A, it being understood that stiff fabric wrapping adds to the overall "equivalent" hardness of header ring 100. In other embodiments, resilient core 132 may have a shore hardness scale more common of prior art header rings, such as 70-90 A.

Annular body 130 has an inner annular surface 104, which includes primary sealing surface 108, that is closest to the primary axis 102, and an outer annular surface 106 that is spaced radially outward from primary sealing surface 108. Primary sealing surface 108 has an uncompressed length L1. In one or more embodiments, outer annular surface 106 has an uncompressed length L2. In one or more embodiments, outer annular surface 106 includes a substantially flat portion 107. In one or more embodiments, the substantially flat portion 107 extends along the full length L2 of outer annular surface 106. Moreover, substantially flat portion 107 of outer annular surface 106 may extend axially so as to be generally parallel with primary axis 102, as well as primary sealing surface 108. In one or more other embodiments, outer annular surface 106 need not include a substantially flat portion 107, but may be shaped as desired for cooperation with other structures (not shown).

Annular body 130 may further be characterized as having an overall height H extending from the most distal portion of first connecting surface 116 to the most distal portion of second connecting surface 118.

Annular body 130 further includes a first connecting surface 116 extending between the inner annular surface 104 and the outer annular surface 106. A second connecting surface 118 spaced apart from the first connecting surface 116 extends between the inner annular surface 104 and the outer annular surface 106.

Optionally, although not limited to a particular shape, in one or more embodiments, second connecting surface 118 may include a substantially flat, radially extending surface 119 that is generally perpendicular to primary axis 102. In other embodiments, second connecting surface 118 may be angled, curved or otherwise shaped to engage an adjacent ring or other component of a sealing assembly (not shown).

In addition to primary sealing surface 108, inner annular surface 104 includes a first transition portion 112 and a second transition portion 114, with primary sealing surface 108 extending linearly between the first transition portion 112 and the second transition portion 114. As shown, primary sealing surface 108 forms an inner flat portion of inner annular surface 104 at the inner most radius R1.

First connecting surface 116 intersects with inner annular surface 104 adjacent first transition portion 112. Second connecting surface 118 intersects with inner annular surface 104 adjacent second transition portion 114.

As described above, elongated primary sealing surface 108 extends axially and is characterized by an uncompressed length L1 where primary sealing surface 108 is substantially flat along length L1. As such, elongated primary sealing surface 108 is parallel with primary axis 102 along length L1. Moreover, because primary sealing surface 108 is positioned between first transition portion 112 and second transition portion 114, it is centrally located relative to first connecting surface 116 and second connecting surface 118. In one or more embodiments, centrally located primary sealing surface 108 of inner annular surface 104 is parallel with at least a portion of outer annular surface 106.

In one or more embodiments, the length L1 of primary sealing surface 108 is less than the length L2 of outer annular surface 106. In one or more embodiments, the length L1 of primary sealing surface 108 is less than the length of substantially flat portion 107 of outer annular surface 106. In some embodiments, outer annular surface 106 is substantially flat along its entire length L2. In one non-liming example, length L1 is at least 10% of length L2. In one non-liming example, length L1 is at least 25% of length L2. In one non-liming example, length L1 is at least 50% of length L2. In one non-liming example, length L1 is between approximately 10% and 80% of the length L2. In one non-liming example, length L1 is less than 50% of the length L2.

In one or more embodiments, the length L1 of centrally located primary sealing surface 108 is at least 10% of overall height H. In one non-liming example, length L1 is at least 25% of overall height H. In one non-liming example, length L1 is at least 50% of overall height H. In one non-liming example, length L1 is between approximately 10% and 80% of the overall height H. In one non-liming example, length L1 is less than 50% of the overall height H.

In any event, in some embodiments, L1 is selected to be of sufficient length that rolling of primary sealing surface 108 is minimized when subjected to movement of a piston (not shown). Thus, in some embodiments, L1 is at least 25% of L2.

Where the first transition portion 112 is radiused to have a convex shape, first transition portion 112 may have a radius R3. Where the second transition portion 114 is radiused to have a convex shape, second transition portion 114 may have a radius R4. In one or more embodiments the dimension of radius R3 and the dimension of radius R4 may be the same, while in other embodiments, the dimensions of radius R3 and radius R4 may differ. In one or more embodiments, one or both of R3 and R4 are at least 25% of H (0.25H) to minimize the stress concentrations at the first transition portion 112 and the second transition portion 114. In one or more embodiments, one or both of R3 and R4 are at least 30% of H (0.3H) to minimize the stress concentrations at the first transition portion 112 and the second transition portion 114.

Although first transition portion 112 and second transition portion 114 are described as radiused in FIGS. 3 and 4, in one or more other embodiments, one or both of first transition portion 112 and second transition portion 114 may be angled away from centrally located primary sealing surface 108. In this regard, a corner may be formed at the intersection of centrally located primary sealing surface 108 and one or both of first transition portion 112 and second transition portion 114. In yet other embodiments, a corner may be formed at the intersection of centrally located primary sealing surface 108 and one of first transition portion 112 and second transition portion 114, while a radius may be formed at the intersection of centrally located primary sealing surface 108 and the other one of first transition portion 112 and second transition portion 114.

Optionally, the inner annular surface 104 may include a shoulder 122 generally formed between the second transition portion 114 and the second connecting surface 118. In such embodiments, shoulder 122 can have an axially extending surface 124 that is substantially parallel with the primary axis 102 and parallel with, but spaced radially outward from primary sealing surface 108 of inner annular surface 104. Thus, inner annular surface 104 may have two axially extending flat surfaces 108, 124 that are spaced axially apart from one another along inner annular surface 104.

Although not limited to a particular shape, in one or more embodiments, first connecting surface 116 may include an axially extending projection or bead 120 formed therealong. As shown axially extending bead 120 projects from first connecting surface 116. In one or more embodiments, axially extending projection 120 intersects with first transition portion 112.

First connecting surface 116 may include an angled portion 134 between the most distal portion of first connecting surface 116 and the outer annular surface 106. In some embodiments, this most distal portion is the axially extending projection 120. Angled portion 134 may be substantially flat and form an angle $\alpha$ of between 0 and 90 degrees with the primary axis 102. It will be appreciated that angled portion 134 slopes away from the most distal portion of first connecting surface 116 to permit enhanced engagement with other annular bodies (See FIG. 2) of a seal assembly (See FIG. 2). However, in one or more embodiments, the angle $\alpha$ is no more than approximately 45 degrees in order to maximize the sealing function, if any, of outer annular surface 106.

In one or more embodiments, a relief area Z may be defined adjacent one or both of first transition portion 112 and second transition portion 114 where inner annular surface 104 intersects with such first transition portion 112 and second transition portion 114. In the illustrated embodiment, a first relief area Z1 is defined adjacent first transition portion 112 and a second relief area Z2 is defined adjacent second transition portion 114. A relief area Z is open volume adjacent one or both ends of inner annular surface 104 into which a portion of inner annular surface 104 can deform under movement of a plunger (not shown) while minimizing nibbling of inner annular surface 104. In one or more embodiments, the central positioning of primary sealing surface 108, at least away from second connecting surface 118 (which is the high pressure end of header ring 100), permits a partial deformation of primary sealing surface 108 into relief area Z2 while minimizing damage to primary sealing surface 108, thereby extending the operational life of header ring 100. An additional benefit to the presence of one or more relief areas Z is that such relief areas Z minimize potential damage to header ring 100 during insertion of a plunger (not shown).

It will further be appreciated that by centrally locating primary sealing surface 108 as described above, primary sealing surface 108 can readily deform into a relief area Z. This is particularly true where a relief area Z is defined adjacent each end of the primary sealing surface 108 such that elongated primary sealing surface 108 is centrally positioned between relief areas Z1 and Z2.

Of course, in such embodiments, it will be appreciated that the length L1 is optimized in order to define relief areas Z1 and Z2. In other words, in some embodiments, if L1 is too long, then there may not enough relief area Z to receive a portion of primary sealing surface 108. Thus, in some embodiments, L1 is no more than 90% of L2.

Figure 1:
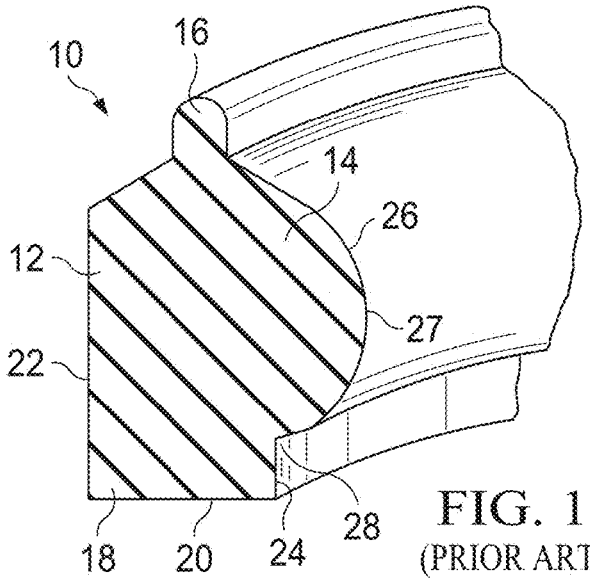
FIG. 1 (PRIOR ART)
FIG. 1 is a cross-sectional view of a prior art header ring prior to installation.

In one or more embodiments, resilient core 132 of header ring 100 may be formed of a stiffer or more rigid material than prior art header rings because primary sealing surface 108 need not be compressed to the same degree as prior art header rings having a convex sealing surface with an apex (see FIG. 1). Moreover, because of the need for significant compression of prior art header rings of the type described herein, a correspondingly large interference fit between the convex sealing surface and the plunger is required of the ring in order to establish the desired seal. In other words, the radial distance R1 of a prior art header ring must be less than the radial distance R1 of header ring 100. This in turn results in expedited wear on the header ring. In contrast, header ring 100 having an inner annular surface 104 shaped as described herein, does not require such compression or the need for such a significant interference fit, and as such, can have a larger inner radial distance R1 than the prior art for use with the same diameter plunger 44 (See FIG. 2). In other words, by avoiding the need for an interference fit as required of the prior art header rings, the operational life of header ring 100 can be extended over header rings of the prior art.

Thus, in one or more embodiments, resilient core 132 may be formed of first material that is less resilient than the material from which a prior art header ring is formed. In one or more embodiments, the first material may be blended or a composite comprised of at least two components. The blended first material forming resilient core 132 may have first component and a second component. In one or more embodiments, any of the foregoing may have a 50% of each of the two components. In any event, it will be appreciated that the stiffer and less resilient the first material (relative to the prior art), the more resistant to abrasion and "nibbling" during use of header ring 100. Additionally, it should also be noted that during the manufacturing process, stiffer first material as described is less likely to result in flashing formation and the need for post molding processing related thereto.

Of course, in other embodiments, resilient core 132 may simply be formed of a homogeneous elastomeric first material. In one or more embodiments, the homogeneous elastomeric first material is natural rubber or synthetic rubber.

Figure 5:
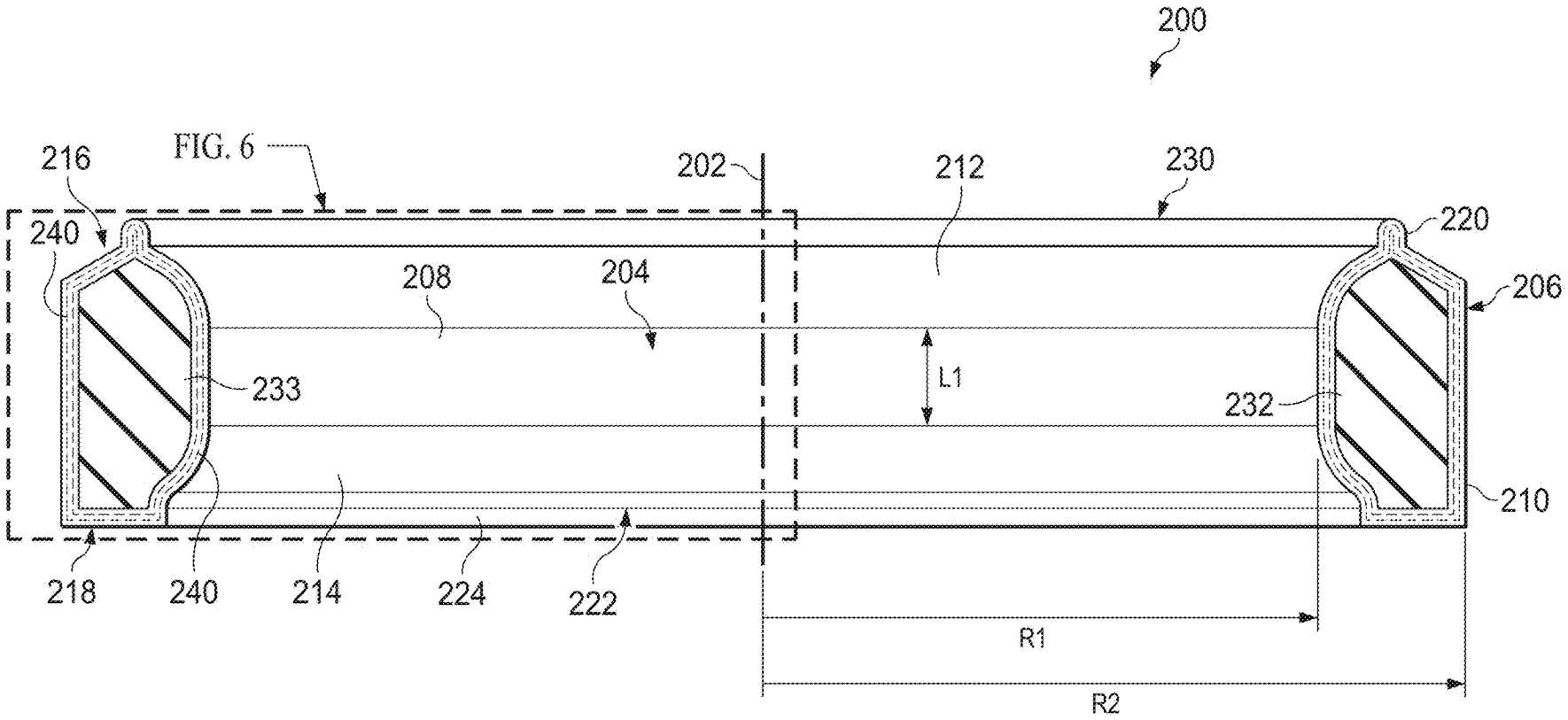
FIG. 5 is a cross-sectional view of another embodiment of a header ring with an elongated piston contact surface.
Figure 6:
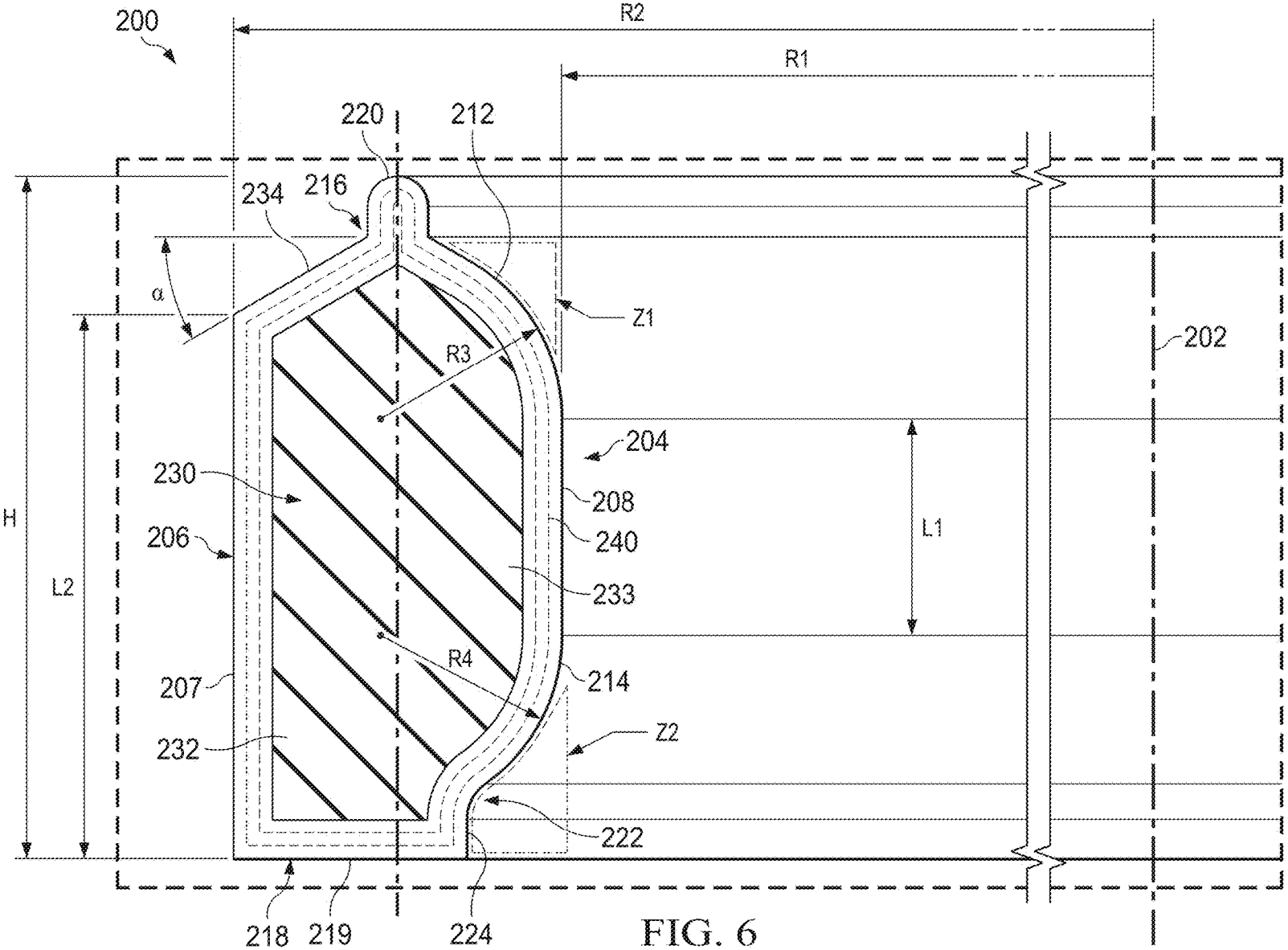
FIG. 6 is another cross-sectional view of the header ring of FIG. 5.

With reference to FIGS. 5 and 6, another embodiment of a header ring 200 is shown. Header ring 200 is similar to header ring 100 of FIGS. 3 and 4, but includes a reinforcing material 240. In these embodiments, reinforcing material 240 is disposed along at least elongated primary sealing surface 208. In some embodiments, reinforcing material 240 may be disposed around all of annular body 230, while in other embodiments, reinforcing material 240 may be disposed around at least a portion of annular body 230, including at least elongated primary sealing surface 208. In one or more embodiments, reinforcing material 240 is a layer of woven material. In one or more embodiments, reinforcing material 240 is a layer of fabric. In one or more embodiments, reinforcing material 240 is an abrasion resistant material, such as a flexible fabric, a semi-rigid thermoplastic lattice with abrasion-resistant and heat-resistant properties, such as polyether ether ketone (PEEK), polyphenylene sulfide (PPS) or flexible thermoplastic lattice with abrasion-resistant and heat-resistant properties, such as thermoplastic polyurethane (TPU) or high-performance polyimides (PI). In yet other embodiments, the abrasion resistant material may only be embedded in or otherwise disposed along the flat, elongated primary sealing surface 208. Reinforcing material 240 may be one or multiple layers of any of the foregoing.

In any event, header ring 200 is illustrated in cross-section disposed about a primary axis 202. Header ring 200 includes an inner annular surface 204 for sealing against a plunger (not shown) and an outer annular surface 206 for engaging a stuffing box wall (not shown) or other structure. Inner annular surface 204 is shaped to have a centrally located, elongated primary sealing surface 208 that is flat at the innermost radius R1 of header ring 200 and has an axial length L1.

By elongating primary sealing surface 208, the contact pressure of primary sealing surface 208 with a plunger (not shown) is spread out over a larger area, thus reducing localized wear and extending the potential operational life of header ring 200. This is in contrast to prior art header rings with a convex sealing surface where peak contact pressure is concentrated at the apex of the convex sealing surface.

In addition, an elongated primary sealing surface 208 as described allows for the optimization of R1 to R2 when header ring 200 is in an uncompressed state. Specifically, R1 is larger than the inner radius of prior art header rings because the need for the significant compression required of a prior art header ring is reduced by header ring 200 while still maintaining the desired sealing. Thus, in one or more embodiments, the ratio of R1 to R2 is larger than the ratio R1 to R2 of prior art header rings. Put another way, the calculated squeeze placed on a piston (not shown) by header ring 200 is less than the calculated squeeze placed on a piston by a prior art header ring with a smaller inner radius R1.

In some embodiments, outer annular surface 206 may be flat at the outermost radius R2 of header ring 200. In other embodiments, outer annular surface 206 need not be flat, but may be shaped to cooperate with the housing 34 (see FIG. 2) or other structure in which header ring 200 is deployed.

Inner annular surface 204 may further include a first transition portion 212 and a second transition portion 214, where first transition portion 212 segues into a first connecting surface 216 and second transition portion 214 segues into second connecting surface 218. In each case, the first transition portion 212 and the second transition portion 214 extend away from the centrally located, elongated primary sealing surface 208 and primary axis 202. In this regard, one or both of first transition portion 212 and the second transition portion 214 may be radiused to have a convex shape. Regardless of the shape of first transition portion 212 and second transition portion 214, primary sealing surface 208 is located therebetween and therefore centrally located along inner annular surface 204. In this regard, for the reasons set forth herein, centrally located, elongated primary sealing surface 208 is spaced apart from at least second connecting surface 218. In yet other embodiments, primary sealing surface 208 is spaced apart from each of first connecting surface 216 and second connecting surface 218 by the respective first transition portion 212 and the second transition portion 214.

While first transition portion 212 and second transition portion 214 are shown as radiused to have a convex shape in FIG. 5, in other embodiments, one or both of first transition portion 212 and second transition portion 214 may be angular in shape so as to form an edge (not shown) at the intersection with primary sealing surface 208.

Optionally, first connecting surface 216 may include an axially extending projection 220.

Optionally, inner annular surface 204 may also include a concave shoulder 222 having an axially extending surface 224 forming a pedestal at second connecting surface 218.

Referring first to FIG. 6, header ring 200 is formed of an annular body 230 disposed about primary axis 202 where annular body 230 is formed of a resilient core 232. Resilient core 232 may be fabricated of at least a first material 233. In one or more embodiments, resilient core 232 may be formed of homogenous rubber. As will be described below, it will be appreciated that because inner annular surface 204 of header ring 200 need not compress to the same degree as prior art header rings in order to achieve desired sealing, resilient core 232 may be formed of a harder, more durable material than prior art header rings. Thus, in one or more embodiments, first material 233 may have an equivalent shore hardness scale of 90 A or greater, where equivalent shore hardness means an unwrapped resilient core 232 of 90 A or a fabric wrapped resilient core of at least 80 A, it being understood that stiff fabric wrapping adds to the overall "equivalent" hardness of header ring 200. In other embodiments, resilient core 232 may have a shore hardness scale more common of prior art header rings, such as 70-90 A.

Annular body 230 has an inner annular surface 204, which includes elongated primary sealing surface 208 that is closest to the primary axis 202, and an outer annular surface 206 that is spaced radially outward from the inner annular surface 204. Elongated primary sealing surface 208 has an uncompressed length L1. In one or more embodiments, outer annular surface 206 has an uncompressed length L2. In one or more embodiments, outer annular surface 206 includes a substantially flat portion 207. In one or more embodiments, the substantially flat portion 207 extends along the full length L2 of outer annular surface 206. Moreover, substantially flat portion 207 of outer annular surface 206 may extend axially so as to be generally parallel with primary axis 202 as well as primary sealing surface 208. In one or more other embodiments, outer annular surface 206 need not include flat portion 207, but may be shaped as desired for cooperation with other structures (not shown).

Annular body 230 may further be characterized as having an overall height H extending from the most distal portion of first connecting surface 216 to the most distal portion of second connecting surface 218.

Annular body 230 further includes a first connecting surface 216 extending between the inner annular surface 204 and the outer annular surface 206. A second connecting surface 218 likewise extends between the inner annular surface 204 and the outer annular surface 206 and is also spaced apart from the first connecting surface 216. Although not limited to a particular shape, in one or more embodiments, second connecting surface 218 may include a substantially flat, radially extending surface 219 that is generally perpendicular to primary axis 202. In other embodiments, second connecting surface 218 may be angled, curved or otherwise shaped to engage an adjacent ring or other component of a sealing assembly (not shown).

In addition to primary sealing surface 208, inner annular surface 204 includes a first transition portion 212 and a second transition portion 214 with elongated primary sealing surface 208 extending linearly between the first transition portion 212 and the second transition portion 214 such that elongated primary sealing surface 208 is centrally located between the first transition portion 212 and the second transition portion 214. As shown, primary sealing surface 208 forms an inner flat portion of inner annular surface 204 at the inner most radius R1.

A reinforcing material 240 is disposed at least along a portion of elongated primary sealing surface 208. Reinforcing material 240 may be embedded or wrapped or otherwise secured to primary sealing surface 208.

First connecting surface 216 intersects with inner annular surface 204 adjacent first transition portion 212. Second connecting surface 218 intersects with inner annular surface 204 adjacent second transition portion 214.

As described above, elongated primary sealing surface 208 extends axially and is characterized by an uncompressed length L1 where primary sealing surface 208 is substantially flat along length L1. As such, elongated primary sealing surface 208 is parallel with primary axis 202 along length L1. Moreover, because primary sealing surface 208 is positioned between first transition portion 212 and second transition portion 214, it is centrally located relative to first connecting surface 216 and second connecting surface 218.

In one or more embodiments, centrally located, elongated primary sealing surface 208 of inner annular surface 204 is parallel with at least a portion of outer annular surface 206.

In one or more embodiments, the length L1 of primary sealing surface 208 is less than the length L2 of outer annular surface 206. In one or more embodiments, the length L1 of primary sealing surface 208 is less than the length of substantially flat portion 207 of outer annular surface 206. In some embodiments, outer annular surface 206 is substantially flat along its entire length L2. In one non-liming example, length L1 is at least 10% of length L2. In one non-liming example, length L1 is at least 25% of length L2. In one non-liming example, length L1 is at least 50% of length L2. In one non-liming example, length L1 is between approximately 10% and 80% of the length L2. In one non-liming example, length L1 is less than 50% of the length L2.

In one or more embodiments, the length L1 of centrally located, elongated primary sealing surface 208 is at least 10% of overall height H. In one non-liming example, length L1 of centrally located primary sealing surface 208 is at least 25% of overall height H. In one non-liming example, length L1 of centrally located primary sealing surface 208 is at least 50% of overall height H. In one non-liming example, length L1 of centrally located primary sealing surface 208 is between approximately 10% and 80% of the overall height H. In one non-liming example, length L1 of centrally located, elongated primary sealing surface 208 is less than 50% of the overall height H.

In any event, in some embodiments, L1 is selected to be of sufficient length that rolling of primary sealing surface 208 is minimized when subjected to movement of a piston (not shown). Thus, in some embodiments, L1 is at least 25% of L2.

In embodiments where first transition portion 212 is radiused to have a convex shape, first transition portion 212 has a radius R3. In embodiments where second transition portion 214 is radiused to have a convex shape, second transition portion 214 has a radius R4. Although not necessary, in one or more embodiments radius R3 and radius R4 are the same, while in other embodiments, the dimensions of radius R3 and radius R4 may differ. In one or more embodiments, one or both of R3 and R4 are at least 25% of H (0.25H) to minimize the stress concentrations at the first transition portion 212 and the second transition portion 214. In one or more embodiments, one or both of R3 and R4 are at least 30% of H (0.3H) to minimize the stress concentrations at the first transition portion 212 and the second transition portion 214.

Although first transition portion 212 and second transition portion 214 are described as radiused in FIGS. 5 and 6, in one or more other embodiments, one or both of first transition portion 212 and second transition portion 214 may be angled away from centrally located primary sealing surface 208. In this regard, a corner may be formed at the intersection of centrally located primary sealing surface 208 and one or both of first transition portion 212 and second transition portion 214. In yet other embodiments, a corner may be formed at the intersection of centrally located primary sealing surface 208 and one of first transition portion 212 and second transition portion 214, while a radius may be formed at the intersection of centrally located primary sealing surface 208 and the other one of first transition portion 212 and second transition portion 214.

Optionally, the inner annular surface 204 may include a shoulder 222 generally formed between the second transition portion 214 and the second connecting surface 218. In such embodiments, shoulder 222 can have an axially extending surface 224 that is substantially parallel with the primary axis 202 and parallel with, but spaced radially outward from, primary sealing surface 208 of inner annular surface 204. Thus, in such embodiments, inner annular surface 204 may have two axially extending flat surfaces 208, 224 that are spaced axially apart from one another along inner annular surface 204.

Although not limited to a particular shape, in one or more embodiments, first connecting surface 216 may include an axially extending projection or bead 220 formed therealong. As shown axially extending bead 220 projects from first connecting surface 216. In one or more embodiments, axially extending projection 220 intersects with first transition portion 212.

First connecting surface 216 may include an angled portion 234 between the most distal portion of first connecting surface 216 and the outer annular surface 206. In some embodiments, this most distal portion is the axially extending projection 220. Angled portion 234 may be substantially flat and form an angle $\alpha$ of between 0 and 90 degrees. It will be appreciated that angled portion 234 slopes away from the most distal portion of first connecting surface 216 to permit enhanced engagement with other annular bodies (See FIG. 2) of a seal assembly (See FIG. 2). However, in one or more embodiments, the angle $\alpha$ is no more than approximately 45 degrees in order to maximize the sealing function, if any, of outer annular surface 206.

In one or more embodiments, a relief area Z may be defined adjacent one or both of first transition portion 212 and second transition portion 214 where inner annular surface 204 intersects with such first transition portion 212 and second transition portion 214. In the illustrated embodiment, a first relief area Z1 is defined adjacent first transition portion 212 and a second relief area Z2 is defined adjacent second transition portion 214. A relief area Z is open volume adjacent one or both ends of inner annular surface 204 into which a portion of inner annular surface 204 can deform under movement of a plunger (not shown) while minimizing nibbling of inner annular surface 204. In one or more embodiments, the central positioning of primary sealing surface 208, at least away from second connecting surface 218 (which is the high pressure end of header ring 200), permits a partial deformation of primary sealing surface 208 into relief area Z2 while minimizing damage to primary sealing surface 208, thereby extending the operational life of header ring 200. An additional benefit to the presence of one or more relief areas Z is that such relief areas Z minimize potential damage to header ring 200 during insertion of a plunger (not shown).

It will further be appreciated that by centrally locating primary sealing surface 208 as described above, primary sealing surface 208 can readily deform into a relief area Z. This is particularly true where a relief area Z is defined adjacent each end of the primary sealing surface 208 such that elongated primary sealing surface 208 is centrally positioned between relief areas Z1 and Z2.

Of course, in such embodiments, it will be appreciated that the length L1 is optimized in order to define relief areas Z1 and Z2. In other words, in some embodiments, if L1 is too long, then there may not enough relief area Z to receive a portion of primary sealing surface 208. Thus, in some embodiments, L1 is no more than 90% of L2.

Reinforcing material 240 is disposed at least along a portion of primary sealing surface 208, but may be disposed on or along first transition portion 212 and a second transition portion 214 as well. In other embodiments, reinforcing material 240 is on or disposed along outer annular surface 206. In other embodiments, reinforcing material 240 is on or disposed along one or both of first connecting surface 216 and second connecting surface 218.

The inner annular surface 204 is formed of a with primary sealing surface 208 extending between the first transition portion 212 and the second transition portion 214. As shown, primary sealing surface 208 forms an inner flat portion of inner annular surface 204 at the inner most radius R1. A reinforcing material 240 is disposed at least on or along primary sealing surface 208. Reinforcing material 240 may be embedded or wrapped or otherwise secured to primary sealing surface 208.

In one or more embodiments, resilient core 232 of header ring 200 may be formed of a stiffer or more rigid material than prior art header rings because primary sealing surface 208 need not be compressed to the same degree as prior art header rings having a convex sealing surface with an apex (see FIG. 1) in order to achieve a desired sealing. Moreover, because of the need for significant compression of prior art header rings of the type described herein, a correspondingly large interference fit between the convex sealing surface and the plunger is required of the ring in order to establish the desired seal. In other words, the radial distance R1 of a prior art header ring must be less than the radial distance R1 of header ring 200. This in turn results in expedited wear on the header ring. In contrast, header ring 200 having an inner annular surface 204 shaped as described herein, does not require such compression or the need for such a significant interference fit, and as such, can have a larger inner radial distance R1 than the prior art for use with the same diameter plunger 44 (See FIG. 2). In other words, by avoiding the need for a larger interference fit as required of the prior art header rings, the operational life of header ring 200 can be extended over header rings of the prior art.

Thus, in one or more embodiments, resilient core 232 may be formed of first material 233 that is less resilient than the material from which a prior art header ring is formed. In one or more embodiments, the first material 233 may be blended or a composite comprised of at least two components. The blended first material forming resilient core 232 may have first component and a second component. In one or more embodiments, any of the foregoing may have a 50% of each of the two components. In any event, it will be appreciated that the stiffer and less resilient the first material (relative to the prior art), the more resistant to abrasion and "nibbling" during use of header ring 200. Additionally, it should also be noted that during the manufacturing process, stiffer first material 233 as described is less likely to result in flashing formation and the need for post molding processing related thereto.

Of course, in other embodiments, resilient core 232 may simply be formed of an elastomeric first material 233, which in some embodiments may be embedded or wrapped or otherwise partially or fully encased in reinforcing material 240. In one or more embodiments, the elastomeric first material 233 is natural rubber or synthetic rubber.

Figure 7:
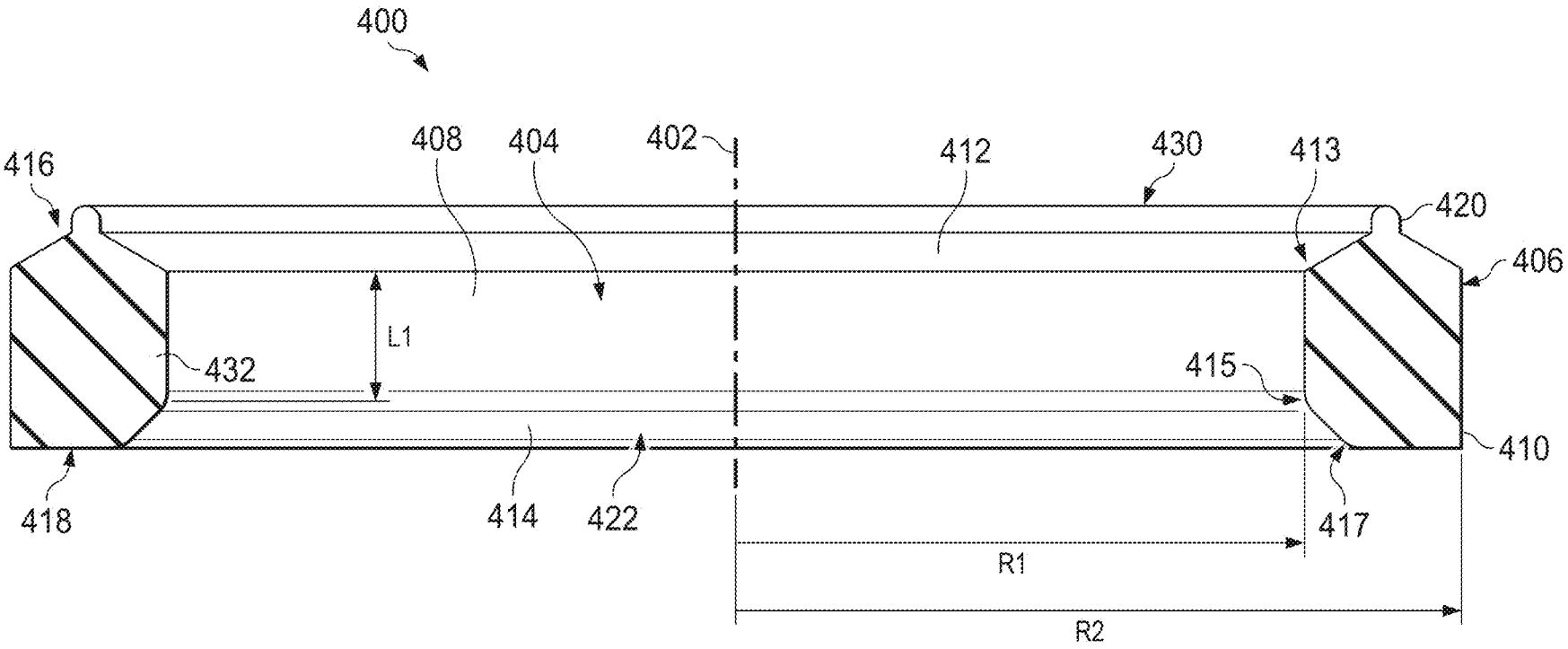
FIG. 7 is a cross-sectional view of one embodiment of a header ring with an elongated piston contact surface.

With reference to FIG. 7, a header ring 400 is illustrated in cross-section where header ring 400 is formed of an annular body 430 disposed about primary axis 402. Annular body 430 includes an inner annular surface 404 for sealing against a plunger (not shown) and an outer annular surface 406 for engaging a stuffing box wall (not shown) or other structure. Inner annular surface 404 is shaped to have a centrally located, elongated primary sealing surface 408 that is flat at the innermost radius R1 of header ring 400 and has an uncompressed axial length L1. As used herein, uncompressed means that elongated primary sealing surface 408 has length L1 prior to deployment or engagement with a piston shaft. For the purposes of this disclosure, any reference to length L1 refers to the length of elongated primary sealing surface 408 in an uncompressed state.

By elongating primary sealing surface 408, the contact pressure of primary sealing surface 408 with a plunger (not shown) is spread out over a larger area, thus reducing localized wear and extending the potential operational life of header ring 400. This is in contrast to prior art header rings with a convex sealing surface where peak contact pressure is concentrated at the apex of the convex sealing surface.

In addition, an elongated primary sealing surface 408 as described allows for the optimization of R1 to R2 when header ring 400 is in an uncompressed state. Specifically, R1 is larger than the inner radius of prior art header rings because the need for the significant compression required of a prior art header ring is reduced by header ring 400 while still maintaining the desired sealing. Thus, in one or more embodiments, the ratio of R1 to R2 is larger than the ratio R1 to R2 of prior art header rings. Put another way, the calculated squeeze placed on a piston (not shown) by header ring 400 is less than the calculated squeeze placed on a piston by a prior art header ring with a smaller inner radius R1.

Outer annular surface 406 may likewise include an elongated surface 410 that may be flat at the outermost radius R2 of header ring 400. In other embodiments, outer annular surface 406 need not be flat, but may be shaped to cooperate with the housing 34 (see FIG. 2) or other structure in which header ring 400 is deployed.

Inner annular surface 404 may further include a first transition portion 412 and a second transition portion 414, where first transition portion 412 segues into a first connecting surface 416 and second transition portion 414 segues into second connecting surface 418. In each case, the first transition portion 412 and the second transition portion 414 extend away from the centrally located, elongated primary sealing surface 408 and primary axis 402. In this regard, one or both of first transition portion 412 and the second transition portion 414 may be flat, extending linearly away from elongated primary sealing surface 408. Regardless of the shape of first transition portion 412 and second transition portion 414, elongated primary sealing surface 408 is located therebetween and therefore centrally located along inner annular surface 404. In this regard, for the reasons set forth herein, centrally located, elongated primary sealing surface 408 is spaced apart from each of first connecting surface 416 and second connecting surface 418 by the respective first transition portion 412 and the second transition portion 414.

In one or more embodiments, the intersection of first transition portion 412 and elongated primary sealing surface 408 may form an angled corner, while in one or more embodiments, the intersection of first transition portion 412 and elongated primary sealing surface 408 may form a filleted corner. The embodiment of FIG. 7 illustrates an angled corner 413. As such, in one or more embodiments, first transition portion 412 may be angled away from elongated primary sealing surface 408.

In one or more embodiments, the intersection of second transition portion 414 and elongated primary sealing surface 408 may form an angled corner, while in one or more embodiments, the intersection of second transition portion 414 and elongated primary sealing surface 408 may form a filleted corner. The embodiment of FIG. 7 illustrates a filleted corner 415.

In one or more embodiments, second transition portion 414 may form an angle σ relative to elongated primary sealing surface 408. In one or more embodiments, angle σ may be approximately 45 degrees.

Optionally, first connecting surface 416 may include a projection 420 extending away from first connecting surface 416, where projection 420 is disposed to engage an adjacent seal component (not shown) as is known in the art.

Optionally, header ring 400 may be fully or partially wrapped or embedded with an abrasion resistant material, such as a flexible fabric, a semi-rigid thermoplastic lattice with abrasion-resistant and heat-resistant properties, such as polyether ether ketone (PEEK), polyphenylene sulfide (PPS) or flexible thermoplastic lattice with abrasion-resistant and heat-resistant properties, such as thermoplastic polyurethane (TPU) or high-performance polyimides (PI). In yet other embodiments, the abrasion resistant material may only be embedded in or otherwise disposed along the flat, elongated primary sealing surface 408.

Figure 8:
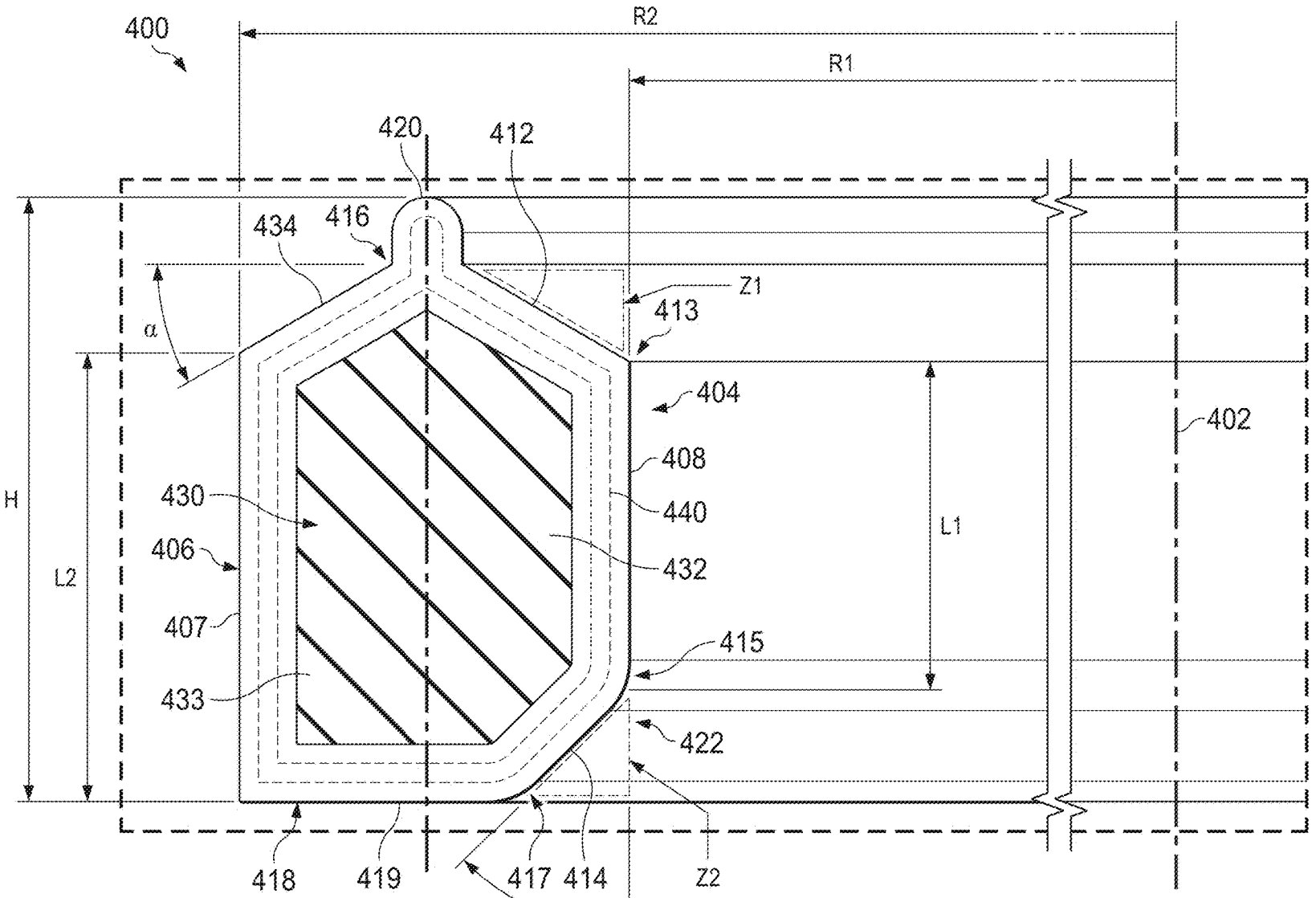
FIG. 8 is a cross-sectional view of a header ring similar to the header ring of FIG. 7, but with a reinforcing material.

FIG. 8 illustrates the header ring 400 of FIG. 7 but includes reinforcing material 440 disposed about a resilient core 432 forming annular body 430 (unlike the embodiment shown in FIG. 7). Resilient core 132 may be fabricated of at least a first material 433. In one or more embodiments, resilient core 432 may be formed of homogenous rubber. As will be described below, it will be appreciated that because inner annular surface 404 of header ring 400 need not compress to the same degree as prior art header rings in order to achieve desired sealing, resilient core 432 may be formed of a harder, more durable material than prior art header rings. Thus, in one or more embodiments, first material 433 may have an equivalent shore hardness scale of 90 A or greater, where equivalent shore hardness means an unwrapped resilient core 432 of 90 A or a fabric wrapped resilient core of at least 80 A, it being understood that stiff fabric wrapping adds to the overall "equivalent" hardness of header ring 400. In other embodiments, resilient core 432 may have a shore hardness scale more common of prior art header rings, such as 70-90 A.

Annular body 430 has an inner annular surface 404, which includes elongated primary sealing surface 408, that is closest to the primary axis 402, and an outer annular surface 406 that is spaced radially outward from primary sealing surface 408. Elongated primary sealing surface 408 has an uncompressed length L1. In one or more embodiments, outer annular surface 406 has an uncompressed length L2. In one or more embodiments, outer annular surface 406 includes a substantially flat portion 407. In one or more embodiments, the substantially flat portion 407 extends along the full length L2 of outer annular surface 406. Moreover, substantially flat portion 407 of outer annular surface 406 may extend axially so as to be generally parallel with primary axis 402, as well as primary sealing surface 408. In one or more other embodiments, outer annular surface 406 need not be flat, but may be shaped as desired for cooperation with other structures (not shown).

Annular body 430 may further be characterized as having an overall height H extending from the most distal portion of first connecting surface 416 to the most distal portion of second connecting surface 418.

Annular body 430 further includes a first connecting surface 416 extending between the inner annular surface 404 and the outer annular surface 406. A second connecting surface 418 spaced apart from the first connecting surface 416 extends between the inner annular surface 404 and the outer annular surface 406.

Optionally, although not limited to a particular shape, in one or more embodiments, second connecting surface 418 may include a substantially flat, radially extending surface 419 that is generally perpendicular to primary axis 402 as shown. In other embodiments, second connecting surface 418 may be angled, curved or otherwise shaped to engage an adjacent ring or other component of a sealing assembly (not shown).

In addition to elongated primary sealing surface 408, inner annular surface 404 includes a first transition portion 412 and a second transition portion 414, with primary sealing surface 408 extending linearly between the first transition portion 412 and the second transition portion 414 and therefore centrally located along inner annular surface 404. As shown, elongated primary sealing surface 408 forms an inner flat portion of inner annular surface 404 at the inner most radius R1.

First connecting surface 416 intersects with inner annular surface 404 adjacent first transition portion 412. Second connecting surface 418 intersects with inner annular surface 404 adjacent second transition portion 414.

As described above, elongated primary sealing surface 408 extends axially and is characterized by an uncompressed length L1 where primary sealing surface 408 is substantially flat along length L1. As such, elongated primary sealing surface 408 is parallel with primary axis 402 along length L1. Moreover, because primary sealing surface 408 is positioned between first transition portion 412 and second transition portion 414, it is centrally located relative to first connecting surface 416 and second connecting surface 418.

In one or more embodiments, centrally located, elongated primary sealing surface 408 of inner annular surface 404 is parallel with at least a portion of outer annular surface 406.

In one or more embodiments, the length L1 of elongated primary sealing surface 408 is less than the length L2 of outer annular surface 406. In one or more embodiments, the length L1 of primary sealing surface 408 is less than the length of substantially flat portion 407 of outer annular surface 406. In some embodiments, outer annular surface 406 is substantially flat along its entire length L2. In one non-liming example, length L1 is at least 10% of length L2. In one non-liming example, length L1 is at least 25% of length L2. In one non-liming example, length L1 is at least 50% of length L2. In one non-liming example, length L1 is between approximately 10% and 80% of the length L2. In one non-liming example, length L1 is less than 50% of the length L2.

In one or more embodiments, the length L1 of centrally located, elongated primary sealing surface 408 is at least 10% of overall height H. In one non-liming example, length L1 of centrally located primary sealing surface 408 is at least 25% of overall height H. In one non-liming example, length L1 of centrally located primary sealing surface 408 is at least 50% of overall height H. In one non-liming example, length L1 of centrally located primary sealing surface 408 is between approximately 10% and 80% of the overall height H. In one non-liming example, length L1 of centrally located, elongated primary sealing surface 408 is less than 50% of the overall height H.

In any event, in some embodiments, L1 is selected to be of sufficient length that rolling of primary sealing surface 408 is minimized when subjected to movement of a piston (not shown). Thus, in some embodiments, L1 is at least 25% of L2. In other embodiments, L1 is at least 10% of L2. However, it will be appreciated that the relationship of L1 to L2 may vary depending on the first material 433 forming resilient core 132, where a stiffer, more rigid first material 433 may be less susceptible to rolling of primary sealing surface 408. Likewise, the presence of a reinforcing material 440 may reduce the likelihood of rolling of primary sealing surface 408.

As noted above, one or both of first transition portion 412 and the second transition portion 414 may be flat as illustrated in FIG. 8, such that each of first transition portion 412 and second transition portion 414 form a corner 413, 415, respectively, with elongated primary sealing surface 408.

In one or more embodiments, the intersection of first transition portion 412 and primary sealing surface 408 may form an angled corner, while in one or more embodiments, the intersection of first transition portion 412 and primary sealing surface 408 may form a filleted corner. The embodiment of FIG. 8 illustrates an angled corner 413.

In one or more embodiments, the intersection of second transition portion 414 and primary sealing surface 408 may form an angled corner, while in one or more embodiments, the intersection of second transition portion 414 and primary sealing surface 408 may form a filleted corner. The embodiment of FIG. 7 illustrates a filleted corner 415.

Similarly, the intersection of second transition portion 414 and second connecting surface 418 may form an angled corner, while in one or more embodiments, the intersection of second transition portion 414 and second connecting surface 418 may form a filleted corner. The embodiment of FIG. 7 illustrates a filleted corner 417.

In one or more embodiments, second transition portion 414 may form an angle $\sigma$ relative to elongated primary sealing surface 408. In one or more embodiments, angle $\sigma$ may be approximately 45 degrees. In such embodiments where angle $\sigma$ is approximately 45 degrees and second connecting surface 418 is substantially perpendicular to primary sealing surface 408, as well as primary axis 402, then corners 415 and 417 may be filleted the same.

Regardless of the shape of corners 415, 417 at second transition portion 414, it has been found that a flat profile such as shown in FIG. 8 reduces stress concentration at the transition between primary sealing surface 408 and second connecting surface 418 much more significantly than if second transition portion 414 were to have a shoulder shape.

Although not limited to a particular shape, in one or more embodiments, first connecting surface 416 may include an axially extending projection or bead 420 formed therealong. As shown axially extending bead 420 projects from first connecting surface 416. In one or more embodiments, axially extending projection 420 intersects with first transition portion 412.

First connecting surface 416 may include an angled portion 434 between the most distal portion of first connecting surface 416 and the outer annular surface 406. In some embodiments, this most distal portion is the axially extending projection 420. Angled portion 434 may be substantially flat and form an angle $\alpha$ of between 0 and 90 degrees with the primary axis 402. It will be appreciated that angled portion 434 slopes away from the most distal portion of first connecting surface 416 to permit enhanced engagement with other annular bodies (See FIG. 2) of a seal assembly (See FIG. 2). However, in one or more embodiments, the angle $\alpha$ is no more than approximately 45 degrees in order to maximize the sealing function, if any, of outer annular surface 406.

In one or more embodiments, angled portion 434 may have the same angle as first transition portion 412 such that angled portion 434 and first transition portion 412 are symmetrical about a vertical axis bisecting header ring 400. In this regard, the first transition portion 412 extends away from elongated inner flat portion 408 at an angle and the first connecting surface 416 extends away from outer annular surface 406 at an angle and wherein the angles of the first transition portion and the first connecting surface are the same such that angled portion 434 and first transition portion 412 are symmetrical.

In one or more embodiments, a relief area Z may be defined adjacent one or both of first transition portion 412 and second transition portion 414 where inner annular surface 204 intersects with such first transition portion 212 and second transition portion 214. In the illustrated embodiment, a first relief area Z1 is defined adjacent first transition portion 412 and a second relief area Z2 is defined adjacent second transition portion 414. A relief area Z is open volume adjacent one or both ends of inner annular surface 404 into which a portion of inner annular surface 404 can deform under movement of a plunger (not shown) while minimizing nibbling of inner annular surface 404. In one or more embodiments, the central positioning of primary sealing surface 408, at least away from second connecting surface 418 (which is the high pressure end of header ring 400), permits a partial deformation of primary sealing surface 408 into relief area Z2 while minimizing damage to primary sealing surface 408, thereby extending the operational life of header ring 400. An additional benefit to the presence of one or more relief areas Z is that such relief areas Z minimize potential damage to header ring 400 during insertion of a plunger (not shown).

It will further be appreciated that by centrally locating primary sealing surface 408 as described above, primary sealing surface 408 can readily deform into a relief area Z. This is particularly true where a relief area Z is defined adjacent each end of the primary sealing surface 408 such that elongated primary sealing surface 408 is centrally positioned between relief areas Z1 and Z2.

Of course, in such embodiments, it will be appreciated that the length L1 is optimized in order to define relief areas Z1 and Z2. In other words, in some embodiments, if L1 is too long, then there may not enough relief area Z to receive a portion of primary sealing surface 408. Thus, in some embodiments, L1 is no more than 90% of L2.

In one or more embodiments, resilient core 432 of header ring 400 may be formed of a stiffer or more rigid than prior art header rings because primary sealing surface 408 need not be compressed to the same degree as prior art header rings having a convex sealing surface with an apex (see FIG. 1). Moreover, because of the need for significant compression of prior art header rings of the type described herein, a correspondingly large interference fit between the convex sealing surface and the plunger is required of the ring in order to establish the desired seal. In other words, the radial distance R1 of a prior art header ring must be less than the radial distance R1 of header ring 400. This in turn results in expedited wear on the header ring. In contrast, header ring 400 having an inner annular surface 404 shaped as described herein, does not require such compression or the need for such a significant interference fit, and as such, can have a larger inner radial distance R1 than the prior art for use with the same diameter plunger 44 (See FIG. 2). In other words, by avoiding the need for an interference fit as required of the prior art header rings, the operational life of header ring 400 can be extended over header rings of the prior art.

Thus, in one or more embodiments, resilient core 432 may be formed of first material that is less resilient than the material from which a prior art header ring is formed. In one or more embodiments, the first material may be blended or a composite comprised of at least two components. The blended first material forming resilient core 432 may have first component and a second component. In one or more embodiments, any of the foregoing may have a 50% of each of the two components. In any event, it will be appreciated that the stiffer and less resilient the first material (relative to the prior art), the more resistant to abrasion and "nibbling" during use of header ring 400. Additionally, it should also be noted that during the manufacturing process, stiffer first material as described is less likely to result in flashing formation and the need for post molding processing related thereto.

Of course, in other embodiments, resilient core 432 may simply be formed of an elastomeric first material. In one or more embodiments, the elastomeric first material is natural rubber or synthetic rubber.

Figure 9:
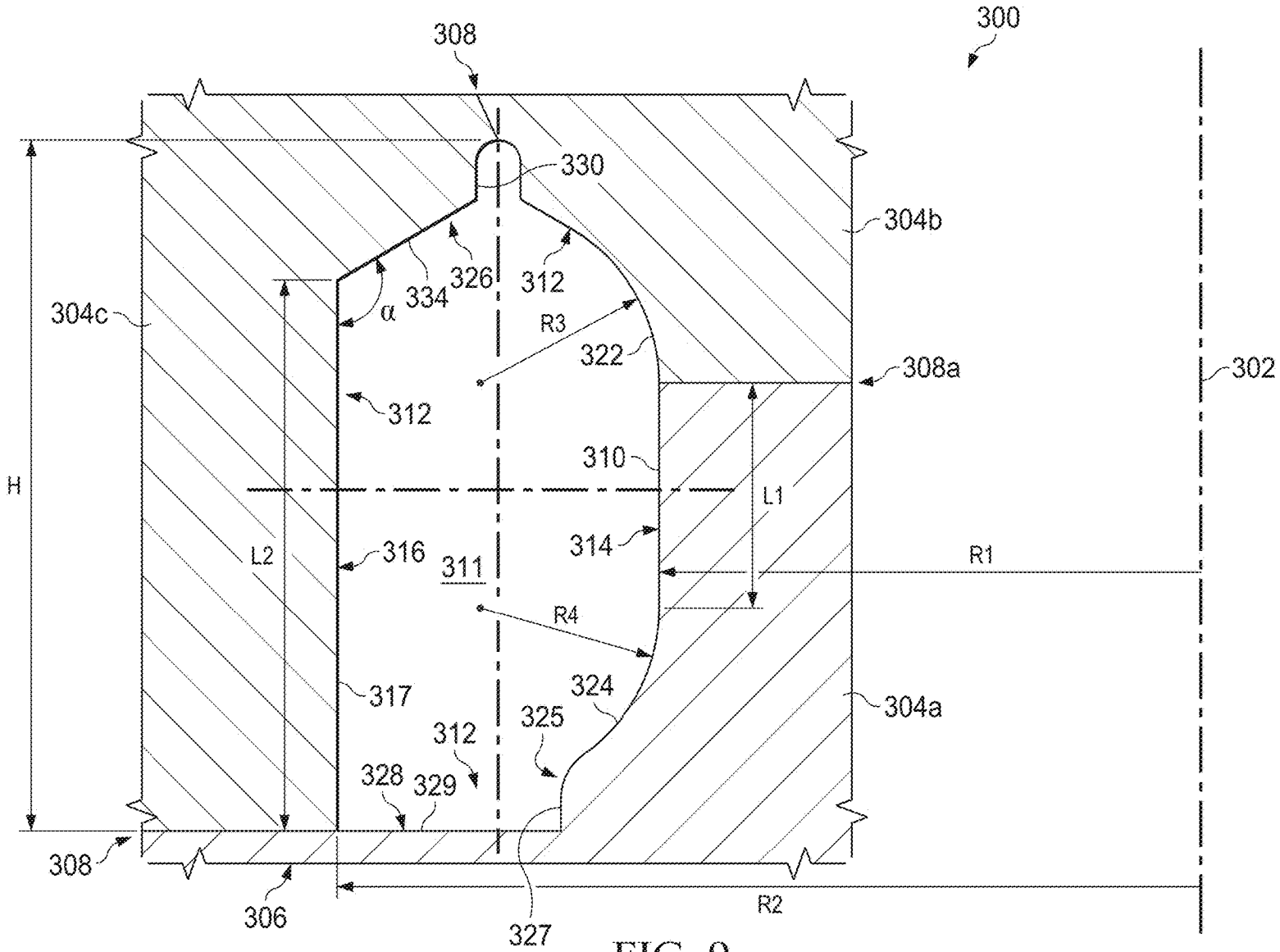
FIG. 9 is a cross-sectional view of an embodiment of a header ring mold assembly of the present invention.

Turning to FIG. 9, a mold assembly 300 for forming a header ring, such as header ring 100 or header ring 200 shown in FIGS. 4 and 6, respectively, is illustrated in quarter cross-section. Mold assembly 300 is formed about a primary axis 302. Mold assembly 300 includes at least two mold shells 304 disposed to engage one another to form an annular enclosure 306 about primary axis 302. In the illustrated embodiment, three mold shells 304*a*, 304*b*, 304*c* are shown.

Annular enclosure 306 has an interior cavity 311 generally in the shape of header ring 100, described above, which interior cavity 311 is defined by a cavity surface 312.

Cavity surface 312 of annular enclosure 306 has an inner annular surface 314, which includes an elongated inner mold surface 310, that is closest to the primary axis 302, and an outer annular surface 316 that is spaced radially outward from elongated inner mold surface 310. Elongated inner mold surface 310 has a length L1 and is parallel to primary axis 302. As shown, elongated inner mold surface 310 forms an inner flat portion of inner annular surface 314 at the inner most radius R1.

In one or more embodiments, outer annular surface 316 includes a substantially flat portion 317 with a length L2. Moreover, substantially flat portion 317 of outer annular surface 316 may extend axially so as to be generally parallel with primary axis 302, as well as elongated inner mold surface 310. In one or more other embodiments, outer annular surface 316 need not be flat, but may be shaped as desired.

Inner annular surface 314 of cavity surface 312 further includes a first transition portion 322 and a second transition portion 324, where first transition portion 322 segues into a first connecting surface 326 and second transition portion 324 segues into second connecting surface 328. In each case, the first transition portion 322 and the second transition portion 324 extend away from the elongated inner mold surface 310 and primary axis 302. In this regard, one or both of first transition portion 322 and second transition portion 324 may be radiused to have a concave shape. Regardless of the shape of first transition portion 322 and second transition portion 324, elongated inner mold surface 310 is located therebetween and therefore centrally located along inner annular surface 314.

While first transition portion 322 and second transition portion 324 are shown as radiused to have a concave shape in FIG. 9, in other embodiments, one or both of first transition portion 322 and second transition portion 324 may be angular in shape so as to form an edge (not shown) at the intersection with primary elongated inner mold surface 310.

Cavity surface 312 further includes a first connecting surface 326 extending between the first transition portion 322 and the outer annular surface 316. A second connecting surface 328, spaced apart from the first connecting surface 326, extends between the second transition portion 324 and the outer annular surface 316.

Optionally, inner annular surface 314 of cavity surface 312 may also include a shoulder surface 325 generally formed between the second transition portion 324 and the second connecting surface 328. In one or more embodiments, shoulder surface 325 may be convex in shape and transition into an axially extending surface 327 that is substantially parallel with the primary axis 302 and parallel with, but spaced radially outward from elongated inner mold surface 310 of inner annular surface 314. Thus, inner annular surface 314 may have two axially extending flat surfaces 310, 327 that are spaced axially apart from one another along inner annular surface 314.

As shown, elongated inner mold surface 310 of cavity surface 312 is spaced apart from each of first connecting surface 326 of cavity surface 312 and second connecting surface 328 of cavity surface 312 by the respective first transition portion 322 and the second transition portion 324 and therefore is centrally located between the first connecting surface 326 and second connecting surface 328.

Interior cavity 311 may further be characterized as having an overall height H extending from the most distal portion of first connecting surface 326 to the most distal portion of second connecting surface 328.

Although not limited to a particular shape, in one or more embodiments, second connecting surface 328 of cavity surface 312 may include a substantially flat, radially extending surface 329 that is generally perpendicular to primary axis 302 as shown. In other embodiments, second connecting surface 328 of cavity surface 312 may be angled, curved or otherwise shaped.

In one or more embodiments, the length L1 of elongated inner mold surface 310 is less than the length L2 of outer annular surface 316. In one or more embodiments, the length L1 of elongated inner mold surface 310 is less than the length of substantially flat portion 317 of outer annular surface 316. In some embodiments, outer annular surface 316 is substantially flat along its entire length L2. In one non-liming example, length L1 is at least 10% of length L2. In one non-liming example, length L1 is at least 25% of length L2. In one non-liming example, length L1 is at least 50% of length L2. In one non-liming example, length L1 is between approximately 10% and 80% of the length L2. In one non-liming example, length L1 is less than 50% of the length L2.

In one or more embodiments, the length L1 of elongated inner mold surface 310 is at least 10% of overall height H. In one non-liming example, length L1 of elongated inner mold surface 310 is at least 25% of overall height H. In one non-liming example, length L1 of elongated inner mold surface 310 is at least 50% of overall height H. In one non-liming example, length L1 of elongated inner mold surface 310 is between approximately 10% and 80% of the overall height H. In one non-liming example, length L1 of elongated inner mold surface 310 is less than 50% of the overall height H.

Where the first transition portion 322 is radiused to have a concave shape, first transition portion 322 may have a radius R3. Where the second transition portion 324 is radiused to have a concave shape, second transition portion 324 may have a radius R4. In one or more embodiments the dimension of radius R3 and the dimension of radius R4 may be the same, while in other embodiments, the dimensions of radius R3 and radius R4 may differ. In one or more embodiments, one or both of R3 and R4 are at least 25% of H (0.25H) to minimize the stress concentrations at the first transition portion 312 and the second transition portion 314. In one or more embodiments, one or both of R3 and R4 are at least 30% of H (0.3H) to minimize the stress concentrations at the first transition portion 312 and the second transition portion 314.

Although not limited to a particular shape, in one or more embodiments, first connecting surface 326 may include an axially extending portion 330 formed therealong. As shown axially extending portion 330 projects axially away from second connecting surface 328. In one or more embodiments, axially extending portion 320 of cavity surface 312 intersects with first transition portion 322 of cavity surface 312.

First connecting surface 326 of cavity surface 312 may include an angled portion 334 between the most distal portion of first connecting surface 326 and the outer annular surface 316. In one or more embodiments, angled portion 334 is substantially flat and forms an angle $\alpha$ of between 90 and 180 degrees with outer annular surface 316. In one or more embodiments, angle $\alpha$ is selected so that angled portion 334 slopes away from the most distal portion of first connecting surface 326. In one or more embodiments, the angle $\alpha$ is approximately 135 degrees.

As described above, mold assembly 300 includes two or more mold shells 304 disposed to abut one another which collectively define the cavity surface 312, where each mold shell 304 defines a portion of the cavity surface 312. Where two adjacent mold shells 304 abut one another, a mold joint 308 is formed. In one or more embodiments, any number of mold shells 304 may be utilized to form mold assembly 300 so long as a mold joint 308 between adjacent mold shells 304 is not disposed along elongated inner mold surface 310 as described above.

In the illustrated embodiment, mold joint 308*a* is formed between first mold shell 304*a* and second mold shell 304*b*. In this embodiment, inner mold surface 310 is only defined by a single mold shell, namely mold shell 308*a*, such that when first mold shell 304*a* and second mold shell 304*b* abut one another, mold joint 308*a* is not defined along inner mold surface 310, but rather is defined adjacent inner mold surface 310 at the intersection of inner mold surface 310 with first transition portion 322. In other embodiments (not shown), a mold joint 308 may be defined adjacent inner mold surface 310 at the intersection of inner mold surface 310 with second transition portion 324, while in other embodiments, a mold joint 308 need not be adjacent inner mold surface 310 at all. In any event, by ensuring that mold joint 308*a* is not formed along inner mold surface 310, any flashing that may result during the formation of a header ring utilizing mold assembly 300 will be spaced apart from the primary sealing surface of the header ring. This in turn minimizes the need for any post mold processing along the primary sealing surface of the produced header ring that could otherwise impact sealing performance of the header ring.

Figure 10:
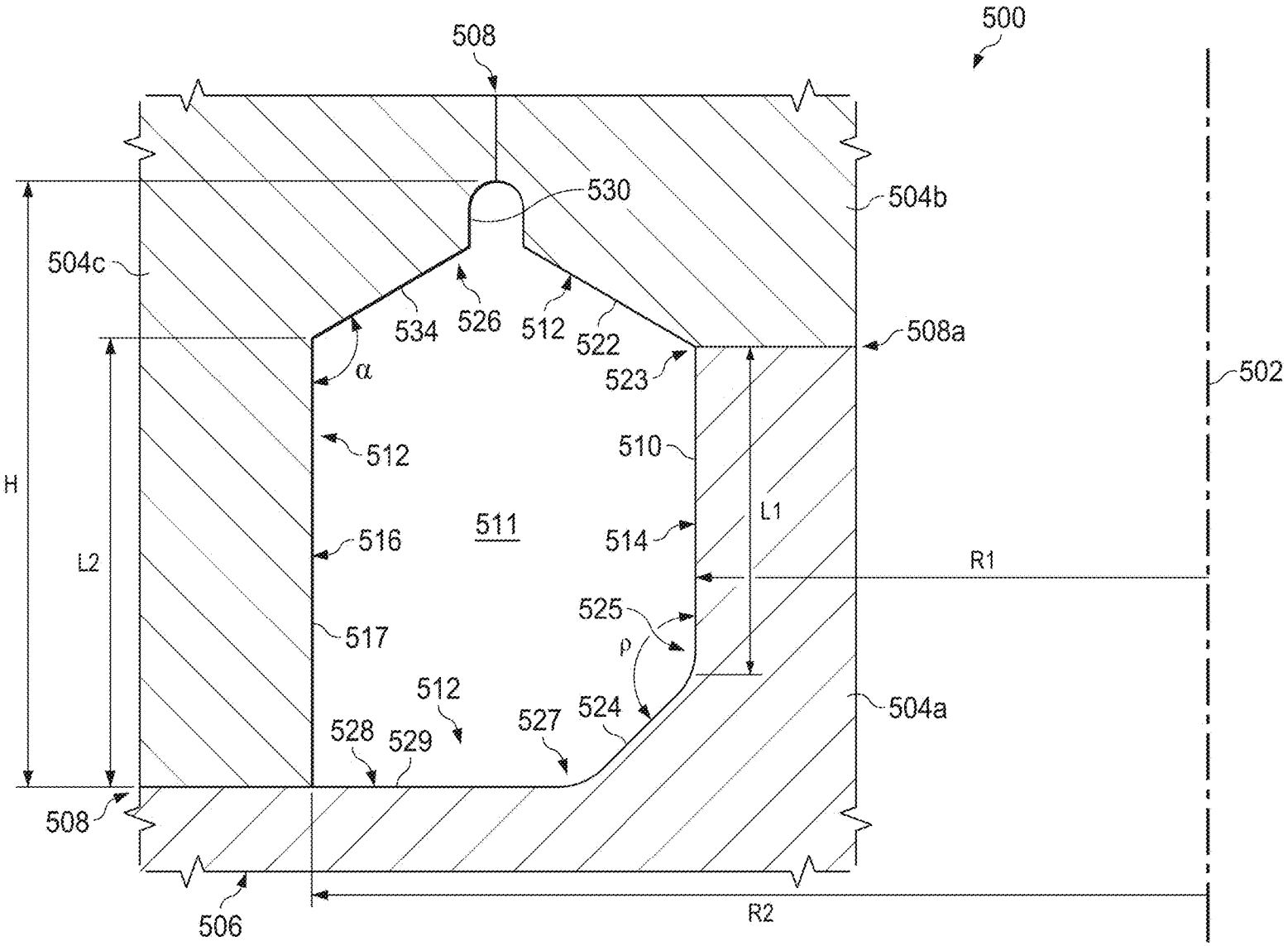
FIG. 10 is a cross-sectional view of another embodiment of a header ring mold assembly of the present invention.

Turning to FIG. 10, a mold assembly 500 for forming a header ring, such as header ring 400 shown in FIGS. 7 and 8, is illustrated in quarter cross-section. Mold assembly 500 is formed about a primary axis 502. Mold assembly 500 includes at least two mold shells 504 disposed to engage one another to form an annular enclosure 506 about primary axis 502. In the illustrated embodiment, three mold shells 504*a*, 504*b*, 504*c* are shown.

Annular enclosure 506 has an interior cavity 511 generally in the shape of header ring 400 described above which interior cavity 511 is defined by a cavity surface 512.

Cavity surface 512 of annular enclosure 506 has an inner annular surface 514, which includes an elongated inner mold surface 510, that is closest to the primary axis 502, and an outer annular surface 516 that is spaced radially outward from elongated inner mold surface 510. Elongated inner mold surface 510 has a length L1 and is parallel to primary axis 502. As shown, elongated inner mold surface 510 forms an inner flat portion of inner annular surface 514 at the inner most radius R1.

In one or more embodiments, outer annular surface 516 includes a substantially flat portion 517 with a length L2. Moreover, substantially flat portion 517 of outer annular surface 516 may extend axially so as to be generally parallel with primary axis 502, as well as elongated inner mold surface 510. In one or more other embodiments, outer annular surface 516 need not be flat, but may be shaped as desired.

Inner annular surface 514 of cavity surface 512 further includes a first transition portion 522 and a second transition portion 524, where first transition portion 522 segues into a first connecting surface 526 and second transition portion 524 segues into second connecting surface 528. In each case, the first transition portion 522 and the second transition portion 524 extend away from the elongated inner mold surface 510 and primary axis 502. In this regard, one or both of first transition portion 522 and second transition portion 524 may be flat. Regardless of the shape of first transition portion 522 and second transition portion 524, elongated inner mold surface 510 is located therebetween and therefore centrally located along inner annular surface 514.

Cavity surface 512 further includes a first connecting surface 526 extending between the first transition portion 522 and the outer annular surface 516. A second connecting surface 528, spaced apart from the first connecting surface 526, extends between the second transition portion 524 and the outer annular surface 516.

As shown, elongated inner mold surface 510 of cavity surface 512 is spaced apart from each of first connecting surface 526 of cavity surface 512 and second connecting surface 528 of cavity surface 512 by the respective first transition portion 522 and the second transition portion 524 and therefore is centrally located between the first connecting surface 526 and second connecting surface 528.

In one or more embodiments, the intersection of first transition portion 522 of cavity surface 512 and elongated inner mold surface 510 of cavity surface 512 may form a corner 523. In one or more embodiments, corner 523 may be angled while in other embodiments, corner 523 may be filleted. The embodiment of FIG. 10 illustrates corner 523 as angled.

Interior cavity 511 may further be characterized as having an overall height H extending from the most distal portion of first connecting surface 526 to the most distal portion of second connecting surface 528.

Although not limited to a particular shape, in one or more embodiments, second connecting surface 528 of cavity surface 512 may include a substantially flat, radially extending surface 529 that is generally perpendicular to primary axis 502 as shown. In other embodiments, second connecting surface 528 of cavity surface 512 may be angled, curved or otherwise shaped.

In one or more embodiments, the length L1 of elongated inner mold surface 510 is less than the length L2 of outer annular surface 516. In one or more embodiments, the length L1 of elongated inner mold surface 510 is less than the length of substantially flat portion 517 of outer annular surface 516. In some embodiments, outer annular surface 516 is substantially flat along its entire length L2. In one non-liming example, length L1 is at least 10% of length L2. In one non-liming example, length L1 is at least 25% of length L2. In one non-liming example, length L1 is at least 50% of length L2. In one non-liming example, length L1 is between approximately 10% and 80% of the length L2. In one non-liming example, length L1 is less than 50% of the length L2.

In one or more embodiments, the length L1 of elongated inner mold surface 510 is at least 10% of overall height H. In one non-liming example, length L1 of elongated inner mold surface 510 is at least 25% of overall height H. In one non-liming example, length L1 of elongated inner mold surface 510 is at least 50% of overall height H. In one non-liming example, length L1 of elongated inner mold surface 510 is between approximately 10% and 80% of the overall height H. In one non-liming example, length L1 of elongated inner mold surface 510 is less than 50% of the overall height H.

As noted above, one or both of first transition portion 522 of cavity surface 512 and second transition portion 524 of cavity surface 512 may be flat as illustrated in FIG. 10, such that each of first transition portion 522 and second transition portion 524 form a corner 523, 525, respectively, with elongated inner mold surface 510.

In one or more embodiments, the intersection of second transition portion 524 and elongated inner mold surface 510 forms corner 525. In one or more embodiments, corner 525 may be angled, while in other embodiments, corner 525 may be filleted. The embodiment of FIG. 10 illustrates corner 525 as filleted.

Similarly, the intersection of second transition portion 524 of cavity surface 512 and second connecting surface 528 of cavity surface 512 may form a corner 527. In one or more embodiments, corner 527 may be angled while in other embodiments, corner 527 may be filleted. The embodiment of FIG. 10 illustrates corner 527 as filleted.

In one or more embodiments, second transition portion 524 may form an angle ρ relative to elongated inner mold surface 510. In one or more embodiments, angle ρ may be approximately 135 degrees. In such embodiments where angle ρ is approximately 135 degrees and second connecting surface 528 is substantially perpendicular to elongated inner mold surface 510, as well as primary axis 502, then corners 525 and 527 may be angled or filleted the same. In one or more other embodiments, angle ρ may be between 90 and 180 degrees.

Although not limited to a particular shape, in one or more embodiments, first connecting surface 526 may include an axially extending portion 530 formed therealong. As shown axially extending portion 530 projects axially away from second connecting surface 528. In one or more embodiments, axially extending portion 520 of cavity surface 512 intersects with first transition portion 522 of cavity surface 512.

First connecting surface 526 of cavity surface 512 may include an angled portion 534 between the most distal portion of first connecting surface 526 and the outer annular surface 516. In one or more embodiments, angled portion 534 is substantially flat and forms an angle α of between 90 and 180 degrees with outer annular surface 516. In one or more embodiments, angle α is selected so that angled portion 534 slopes away from the most distal portion of first connecting surface 526. In one or more embodiments, the angle α is approximately 135 degrees.

As described above, mold assembly 500 includes two or more mold shells 504 disposed to abut one another which collectively define the cavity surface 512, where each mold shell 504 defines a portion of the cavity surface 512. Where two adjacent mold shells 504 abut one another, a mold joint 508 is formed. In one or more embodiments, any number of mold shells 504 may be utilized to form mold assembly 500 so long as a mold joint 508 between adjacent mold shells 504 is not disposed along elongated inner mold surface 510 as described above.

In the illustrated embodiment, mold joint **508*a* is formed between first mold shell 504*a* and second mold shell 504*b*. In this embodiment, inner mold surface 510 is only defined by a single mold shell, namely first mold shell 504*a*, such that when first mold shell 504*a* and second mold shell 504*b* abut one another, mold joint 508*a* is not defined along inner mold surface 510, but rather is defined adjacent inner mold surface 510 at corner 523. In other embodiments (not shown), a mold joint 508 may be defined adjacent inner mold surface 510 at corner 525, while in other embodiments, a mold joint 508 need not be adjacent inner mold surface 510 at all. In any event, by ensuring that mold joint 508*a* is not formed along inner mold surface 510, any flashing that may result during the formation of a header ring utilizing mold assembly 500** will be spaced apart from the primary sealing surface of the header ring. This in turn minimizes the need for any post mold processing along the primary sealing surface of the produced header ring that could otherwise impact sealing performance of the header ring.

For the avoidance of doubt, unless otherwise noted, all descriptions of embodiments of the header rings of the disclosure, including without limitation, header rings 100, 200 and 400, are of a header ring in an uncompressed stated.

Thus, a header ring adapted to be engageable with a reciprocating, cylindrical member and a cylindrical wall of a housing in which the cylindrical member reciprocates has been described.

In one or more embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface; wherein the inner annular surface has a first transition portion extending away from the primary axis and a second transition portion extending away from the primary axis with an elongated inner flat portion extending axially and linearly between the first transition portion and the second transition portion so as to be parallel with the primary axis.

In one or more embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface, wherein the second connecting surface is substantially flat an perpendicular to the primary axis; wherein the inner annular surface has a substantially flat first transition portion extending linearly away from the primary axis, a substantially flat second transition portion extending linearly away from the primary axis and an elongated inner flat portion intersecting each of the first transition portion and the second transition portion, the elongated inner flat portion extending axially and linearly between the first transition portion and the second transition portion so as to be parallel with the primary axis with a first corner formed at the intersection of the first transition portion and the elongated inner flat portion and a second corner formed at an intersection of the second transition portion and the elongated inner flat portion.

In one or more embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface, wherein the second connecting surface is substantially flat and perpendicular to the primary axis; wherein the inner annular surface has a radiused, convex shaped first transition portion extending away from the primary axis, a radiused, convex shaped second transition portion extending away from the primary axis, and an elongated inner flat portion intersecting each of the first transition portion and the second transition portion, the elongated inner flat portion extending axially and linearly between the first transition portion and the second transition portion so as to be parallel with the primary axis.

In one or more embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface; wherein the inner annular surface has a first transition portion and a second transition portion with an inner flat portion extending between the first transition portion and the second transition portion.

In other embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface; wherein the inner annular surface has a first transition portion of radius R1 and a second transition portion of radius R2 with an inner flat portion extending between the first transition portion and the second transition portion.

In yet other embodiments, the header ring may include an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface; wherein the inner annular surface has a first transition portion extending away from the primary axis and a second transition portion extending away from the primary axis with an inner flat portion of length L1 extending between the first transition portion and the second transition portion when the annular body is in an uncompressed state, the inner flat portion being substantially parallel with the primary axis; wherein the outer annular surface has an outer flat portion of a length L2 that is substantially parallel with the primary axis and the inner flat portion; wherein the first connecting surface includes an axially extending projection and a substantially flat, angled portion extending away from the projection towards the outer annular surface; and wherein the second connecting surface has a substantially flat, radially extending surface that is generally perpendicular to the primary axis.

Any of the foregoing header rings may further include, alone or in combination, any of the following:

- The first transition portion of the inner annular surface is adjacent the first connecting surface and the second transition portion of the inner annular surface is adjacent the second connecting surface.
- The first transition portion is radiused to have a convex shape and has a first radius.
- The second transition portion is radiused to have a convex shape and has a second radius.
- The first transition portion is flat.
- The second transition portion is flat.
- The first radius of the first transition portion is of the same dimension as the second radius of the second transition portion.
- The outer annular surface is substantially flat.
- The outer annular surface has an outer flat portion extending between the first connecting surface and the second connecting surface.
- The outer annular surface has an outer flat portion of a length L1 that is substantially parallel with the primary axis and extending between the first connecting surface and the second connecting surface; and wherein the inner flat portion has a length L2 that is substantially parallel with the primary.
- The second connecting surface is substantially flat.
- The inner annular surface further comprises a shoulder portion between the second transition portion and the second connecting surface.
- The shoulder portion comprises an axially extending portion that is substantially parallel with the primary axis.
- The first connecting surface includes an axially extending projection.
- The first connecting surface includes an angled portion between the axially extending projection and the outer annular surface.
- The angled portion is substantially flat and forms an angle of between 90 and 160 degrees with the primary axis.
- The inner flat portion of the inner annular surface is substantially flat in an uncompressed state.
- The header ring comprises a resilient core.
- The resilient core is formed substantially entirely from a homogeneous elastomeric material.
- The homogeneous elastomeric material is natural rubber or synthetic rubber.
- The inner flat portion has a midpoint bisecting the inner flat portion; and where the first transition surface and the second transition surface are spaced apart from the midpoint of the inner flat surface.

The first transition portion of the inner annular surface is adjacent the first connecting surface and the second transition portion of the inner annular surface is adjacent the second connecting surface.

The outer annular surface is substantially flat.

The inner flat portion has a length L1 that is substantially parallel with the primary axis, and wherein the outer annular surface has an outer flat portion of a length L2 that is substantially parallel with the primary axis and extending between the first connecting surface and the second connecting surface.

The inner annular surface further comprises a shoulder portion between the second transition portion and the second connecting surface, the shoulder portion having an axially extending portion that is substantially parallel with the primary axis and the inner flat portion, but spaced radially outward from the inner flat portion.

The first radius R1 and the second radius R2 are the same.

The annular body is comprised of a resilient core, and at least a portion of the inner annular surface comprises a reinforcing material that is different than the resilient core.

The inner annular surface further comprises a shoulder portion between the second transition portion and the second connecting surface, the shoulder portion having an axially extending portion that is substantially parallel with the primary axis and the inner flat portion, but spaced axially apart and radially outward from the inner flat portion.

The inner annular surface has a first transition portion extending away from the primary axis and a second transition portion extending away from the primary axis with an inner flat portion extending between the first transition portion and the second transition portion.

The inner flat portion of the inner annular surface is parallel with the primary axis along the length of the inner flat portion.

The inner flat portion of the inner annular surface is substantially flat in an uncompressed state.

The annular body has an innermost radius and the inner flat portion is disposed at the innermost radius of the annular body.

The first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

The annular body is formed of an elastomeric first material, and further comprising a reinforcing material disposed along at least the elongated inner flat portion of the inner annular surface, wherein the reinforcing material is different than the elastomeric first material.

The reinforcing material is a flexible woven material encasing the annular body.

The first transition portion of the inner annular surface and the second transition portion of the inner annular surface are radiused and convex in shape.

The first transition portion of the inner annular surface and the second transition portion of the inner annular surface are substantially flat extending linearly away from elongated inner flat portion of the inner annular surface.

An angled corner is formed at an intersection of the first transition portion and the elongated inner flat portion, and wherein a filleted corner is formed at an intersection of the second transition portion and the elongated inner flat portion.

The angle between the second transition portion and the elongated inner flat portion is approximately 45°.

The elongated inner flat portion has a length L1 and the outer annular surface has a length L2, wherein the L1 is between 10% and 80% of L2.

At least a portion of the outer annular surface is parallel with the elongated inner flat portion of the inner annular surface.

At least one of the first transition portion and the second transition portion extend away from the elongated inner flat portion of inner annular surface to define a relief area adjacent at an end of the elongated inner flat portion.

Each of the first transition portion and the second transition portion extend away from the elongated inner flat portion of inner annular surface to define a relief area adjacent each end of the elongated inner flat portion.

The second connecting surface is substantially flat and perpendicular to the primary axis; wherein the outer annular surface is substantially flat and parallel to the primary axis; wherein the first connecting surface is angled away from the outer annular surface; and wherein the inner annular surface includes a shoulder formed therealong between the second transition portion and the second connecting surface, the shoulder having an axially extending portion that is substantially parallel with the inner flat portion, but spaced radially outward from the inner flat portion.

The second connecting surface is substantially flat and perpendicular to the primary axis; wherein the outer annular surface is substantially flat and parallel to the primary axis; wherein the first connecting surface is angled away from the outer annular surface; and wherein a filleted corner is formed at an intersection of the second transition portion and the second connecting surface.

The annular body has a height H; wherein the radiused, convex shape of the first transition portion has a radius R3; where the radiused, convex shape of the second transition portion has a radius R4; and wherein each of R3 and R4 are at least 25% of H (0.25H).

The first corner is angled; wherein the second corner is filleted; wherein the angle between the second transition portion and the elongated inner flat portion is approximately 45°.

The first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

The annular body is formed of an elastomeric first material, and further comprising a reinforcing material disposed along at least the elongated inner flat portion of the inner annular surface, wherein the reinforcing material is different than the elastomeric first material.

The elongated inner flat portion has a length L1 and the outer annular surface has a length L2, wherein the L1 is between 10% and 80% of L2.

The first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

The annular body is formed of an elastomeric first material, and further comprising a reinforcing material disposed along at least the elongated inner flat portion of the inner annular surface, wherein the reinforcing material is different than the elastomeric first material.

The elongated inner flat portion has a length L1 and the outer annular surface has a length L2, wherein the L1 is at least 25% of L2.

The inner annular surface further comprises a shoulder between the second transition portion and the second connecting surface, the shoulder having an axially extending portion that is substantially parallel with the inner flat portion, but spaced axially apart and radially outward from the inner flat portion.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed:

1. A header ring adapted to be engageable with a reciprocating, cylindrical member and a cylindrical wall of a housing in which the cylindrical member reciprocates, the header ring comprising:

an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface;

wherein the inner annular surface has a first transition portion extending away from the primary axis and a second transition portion extending away from the primary axis with an elongated inner flat portion extending axially and linearly between the first transition portion and the second transition portion so as to be parallel with the primary axis;

wherein the first transition portion of the inner annular surface and the second transition portion of the inner annular surface are substantially flat extending linearly away from elongated inner flat portion of the inner annular surface; and wherein an angled corner is formed at an intersection of the first transition portion and the elongated inner flat portion, and wherein a filleted corner is formed at an intersection of the second transition portion and the elongated inner flat portion.

2. The header ring of claim 1, wherein the annular body is formed of an elastomeric first material, and further comprising a reinforcing material disposed along at least the elongated inner flat portion of the inner annular surface, wherein the reinforcing material is different than the elastomeric first material.

3. The header ring of claim 2, wherein the reinforcing material is a flexible woven material encasing the annular body.

4. The header ring of claim 1, wherein the angle between the second transition portion and the elongated inner flat portion is approximately 45°.

5. The header ring of claim 4, wherein the second connecting surface is substantially flat and perpendicular to the primary axis; wherein the outer annular surface is substantially flat and parallel to the primary axis; wherein the first connecting surface is angled away from the outer annular surface; and wherein a filleted corner is formed at an intersection of the second transition portion and the second connecting surface.

6. The header ring of claim 1, wherein the elongated inner flat portion has a length L1 and the outer annular surface has a length L2, wherein the L1 is between 10% and 80% of L2.

7. The header ring of claim 1, wherein at least a portion of the outer annular surface is parallel with the elongated inner flat portion of the inner annular surface.

8. The header ring of claim 1, wherein at least one of the first transition portion and the second transition portion extend away from the elongated inner flat portion of inner annular surface to define a relief area adjacent at an end of the elongated inner flat portion.

9. The header ring of claim 8, wherein each of the first transition portion and the second transition portion extend away from the elongated inner flat portion of inner annular surface to define a relief area adjacent each end of the elongated inner flat portion.

10. The header ring of claim 1, wherein the first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

11. A header ring adapted to be engageable with a reciprocating, cylindrical member and a cylindrical wall of a housing in which the cylindrical member reciprocates, the header ring comprising:

an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface;

wherein the inner annular surface has a first transition portion extending away from the primary axis and a second transition portion extending away from the primary axis with an elongated inner flat portion extending axially and linearly between the first transition portion and the second transition portion so as to be parallel with the primary axis; wherein the first transition portion extends away from elongated inner flat portion at an angle and wherein the first connecting surface extends away from outer annular surface at an angle and wherein the angles of the first transition portion and the first connecting surface are the same.

12. The header ring of claim 11, wherein the annular body is formed of an elastomeric first material, and further comprising a reinforcing material disposed along at least the elongated inner flat portion of the inner annular surface, wherein the reinforcing material is different than the elastomeric first material.

13. The header ring of claim 12, wherein the reinforcing material is a flexible woven material encasing the annular body.

14. The header ring of claim 11, wherein the first transition portion of the inner annular surface and the second transition portion of the inner annular surface are substantially flat extending linearly away from elongated inner flat portion of the inner annular surface.

15. The header ring of claim 11, wherein the first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

16. A header ring adapted to be engageable with a reciprocating, cylindrical member and a cylindrical wall of a housing in which the cylindrical member reciprocates, the header ring comprising:

an annular body disposed about a primary axis, the annular body having an inner annular surface closest to the primary axis; an outer annular surface spaced radially outward from the inner annular surface; a first connecting surface extending between the inner annular surface and the outer annular surface; and a second connecting surface extending between the inner annular surface and the outer annular surface and spaced apart from the first connecting surface, wherein the second connecting surface is substantially flat and perpendicular to the primary axis;

wherein the inner annular surface has a substantially flat first transition portion extending linearly away from the primary axis, a substantially flat second transition portion extending linearly away from the primary axis and an elongated inner flat portion intersecting each of the first transition portion and the second transition portion, the elongated inner flat portion extending axially and linearly between the first transition portion and the second transition portion so as to be parallel with the primary axis with a first corner formed at the intersection of the first transition portion and the elongated inner flat portion and a second corner formed at an intersection of the second transition portion and the elongated inner flat portion; and wherein the first corner is angled; wherein the second corner is filleted; wherein the angle between the second transition portion and the elongated inner flat portion is approximately 45°.

17. The header ring of claim 16, wherein the first transition portion of the inner annular surface is adjacent the first connecting surface and the second transition portion of the inner annular surface is adjacent the second connecting surface and the inner flat portion of the inner annular surface extends from the first transition portion to the second transition portion so as to be centrally located between the first connecting surface and the second connecting surface.

18. The header ring of claim 16, wherein the annular body is formed of an elastomeric first material, and further comprising a reinforcing material disposed along at least the elongated inner flat portion of the inner annular surface, wherein the reinforcing material is different than the elastomeric first material.

19. The header ring of claim 16, wherein the elongated inner flat portion has a length L1 and the outer annular surface has a length L2, wherein the L1 is between 10% and 80% of L2.

20. The header ring of claim 16, wherein the annular body is formed of an elastomeric first material, and further comprising a reinforcing material disposed along at least the elongated inner flat portion of the inner annular surface, wherein the reinforcing material is different than the elastomeric first material.

21. The header ring of claim 20, wherein the reinforcing material is a flexible woven material encasing the annular body.

* * * * *